US007064490B2

(12) United States Patent
Hashimotodani et al.

(10) Patent No.: US 7,064,490 B2
(45) Date of Patent: Jun. 20, 2006

(54) COMPACT SELF-BALLASTED ELECTRODELESS DISCHARGE LAMP AND ELECTRODELESS-DISCHARGE-LAMP LIGHTING DEVICE

(75) Inventors: Kiyoshi Hashimotodani, Osaka (JP); Takeshi Arakawa, Kyoto (JP); Akira Hochi, Nara (JP); Koichi Katase, Kyoto (JP); Yuuji Omata, Osaka (JP); Yoshihisa Hagiwara, Hyogo (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/512,127

(22) PCT Filed: Jul. 2, 2003

(86) PCT No.: PCT/JP03/08447

§ 371 (c)(1),
(2), (4) Date: Oct. 11, 2004

(87) PCT Pub. No.: WO2004/006289

PCT Pub. Date: Jan. 15, 2004

(65) Prior Publication Data

US 2005/0225249 A1 Oct. 13, 2005

(30) Foreign Application Priority Data

Jul. 2, 2002 (JP) ..... 2002-192881

(51) Int. Cl.
*H01J 7/44* (2006.01)
*H01J 1/62* (2006.01)
*H01J 17/20* (2006.01)

(52) U.S. Cl. ..... 315/56; 313/485; 313/568

(58) Field of Classification Search ..... 315/56, 315/248, 267, 326, 344; 313/484, 485, 570–572, 313/576, 639, 642, 634, 568, 637
See application file for complete search history.

(56) References Cited

U.S. PATENT DOCUMENTS 5,291,091 A 3/1994 Eggink et al. ..... 313/161
5,461,284 A * 10/1995 Roberts et al. ..... 315/57
5,825,130 A 10/1998 Nerone et al. ..... 313/635
5,917,291 A * 6/1999 Soules et al. ..... 315/248

(Continued)

FOREIGN PATENT DOCUMENTS

EP 1 050 897 A2 11/2000

(Continued)

OTHER PUBLICATIONS

International Search Report for PCT/JP03/08447, mailed Aug. 12, 2003, ISA/JPO.

(Continued)

*Primary Examiner*—Thuy Vinh Tran
(74) *Attorney, Agent, or Firm*—Harness, Dickey & Pierce, P.L.C.

(57) ABSTRACT

A bulb type electrodeless discharge lamp, comprising a recessed part (102), wherein the maximum diameter of a light emitting tube (101) is 60 to 90 mm and the tube wall load of the light emitting tube (101) is 0.07 to 0.11 W/cm$^2$, and a relation between the diameter Dc of the recessed part (102) and an interval Δh between the top of the recessed part (102) and the top part of the light emitting tube (101) meets the requirement of $\Delta h \leqq 1.15 \times Dc + 1.25$ [mm].

11 Claims, 14 Drawing Sheets

U.S. PATENT DOCUMENTS

| | | | | |
|---|---|---|---|---|
| 5,959,405 | A * | 9/1999 | Soules et al. | 313/635 |
| 6,642,671 | B1 * | 11/2003 | Kurachi et al. | 315/248 |
| 6,650,068 | B1 * | 11/2003 | Kurachi et al. | 315/248 |
| 6,768,248 | B1 * | 7/2004 | Chandler et al. | 313/46 |
| 2002/0036472 | A1 | 3/2002 | Kurachi et al. | 315/246 |

FOREIGN PATENT DOCUMENTS

| | | |
|---|---|---|
| JP | 10-064484 | 3/1998 |
| JP | 10-321194 | 12/1998 |
| JP | 2000-348683 | 12/2000 |
| JP | 2001-273873 | 10/2001 |
| JP | 2001-325920 | 11/2001 |
| JP | 2001-332220 | 11/2001 |
| JP | 2002-93380 | 3/2002 |
| WO | WO-01/35446 A1 | 5/2001 |
| WO | WO-01/88952 A1 | 11/2001 |
| WO | WO-02/07483 A1 | 1/2002 |

OTHER PUBLICATIONS

Written Opinion for PCT/JP03/08447, dated Nov. 4, 2003.
Written Opinion for PCT/JP03/08447, dated Feb. 3, 2004.

* cited by examiner

COMPACT SELF-BALLASTED ELECTRODELESS DISCHARGE LAMP AND ELECTRODELESS-DISCHARGE-LAMP LIGHTING DEVICE

This Application is a National Phase Application under 35 U.S.C. 371 claiming the benefit of PCT/JP03/08447 filed on Jul. 2, 2003, which has the priority based on Application No. Japan 2002-192881 filed on Jul. 2, 2002.

FIELD OF THE INVENTION

The present invention relates to a compact self-ballasted electrodeless discharge lamp and an electrodeless-discharge-lamp lighting device.

BACKGROUND OF THE INVENTION

In recent years, from the viewpoints of global environment protection and economical efficiency, compact self-ballasted fluorescent lamps with electrodes, which are about five times higher in efficiency in comparison with incandescent lamps and also have an operating life time about six times longer than that of incandescent lamps, have been widely used in houses, hotels and the like in place of incandescent lamps. Moreover, recently, in addition to conventionally-used compact self-ballasted fluorescent lamps with electrodes, electrodeless compact self-ballasted fluorescent lamps have been utilized. Since the electrodeless fluorescent lamp, which has no electrodes, has an operating life time that is about two times longer than that of a fluorescent lamp with electrodes, it is expected to spread more and more in the future.

Conventionally, incandescent lamps having various shapes have been devised and put into practical use, and those having a pyriform shape have been most widely used. This shape is defined as A-type in JIS C7710-1988, and is also defined in the same manner internationally in IEC 60887-1988, and in accordance with this standard, similar standards have been set in the United States, Europe, etc. Most of lighting devices for lighting incandescent lamps have been prepared on the premise to be used for these A-type incandescent lamps. For this reason, with respect to the compact self-ballasted fluorescent lamps also, in particular, there have been demands for practically providing the shape and the size similar to those of A-type incandescent lamps.

The size of the generally-used A-type incandescent lamp is set to 60 mm in diameter and 110 mm in height from the top of the bulb to the tip of the base, for example, in the case of the incandescent lamp of 100 W in input power, and in order to replace incandescent lamps, it is important to determine the size of the compact self-ballasted fluorescent lamp so as not to excessively exceed the above-mentioned size.

Different from the incandescent lamp, the fluorescent lamp converts ultraviolet emitted by mercury that has been excited by electric discharge into visible light through a phosphor layer applied onto an external-tube bulb (bulb); thus, the fluorescent lamp functions as a light source. Among the ultraviolet emitted by mercury, in particular, that having luminescent line emission with a wavelength of 253.7 nm has the highest conversion efficiency to visible light in the phosphor layer. In other words, the efficiency of a fluorescent lamp is determined by the radiation efficiency of ultraviolet luminescent line of 253.7 nm. This efficiency in the fluorescent lamp is determined by the number density in mercury atoms inside the lamp, that is, the vapor pressure, and the highest efficiency is achieved in the case of about 6 m Torr (about 798 mPa). This state corresponds to the saturated vapor pressure at about 40° C. of the mercury droplet. For this reason, in an attempt to design a fluorescent lamp having high efficiency, it is desirable to set the temperature of at least a portion of the external-tube bulb to have the lowest temperature (hereinafter, referred to as the coldest point) to the vicinity of 40° C. Thus, excessive mercury vapor is allowed to form droplets at the coldest point.

Here, in general, in the case of a compact self-ballasted fluorescent lamp to be used for substituting an incandescent lamp, the size of the lamp is smaller for the power to be supplied to the lamp in comparison with a tublar fluorescent lamp. For this reason, upon operating, the temperature of the bulb becomes higher, and it is difficult in principle to set the temperature of the bulb to the vicinity of 40° C. In other words, in comparison with the straight tube fluorescent lamp and the like, the compact self-ballasted fluorescent lamp has a greater power per unit surface area, with the result that heat radiation from the lamp surface is not carried out sufficiently to cause a high temperature in the bulb.

With respect to the countermeasures to these problems, for example, Japanese Patent Application Laid-Open No. 11-31476 has proposed a method in which amalgam is used. In this method, by allowing amalgam to adsorb excessive mercury vapor that exceeds the optimal value due to a temperature rise upon operation, the mercury vapor pressure at the time of operation is controlled to the vicinity of the optimal value, and Bi—In based and Bi—Pb—Sn based amalgams, which have a mercury-vapor-pressure-controlling function, are utilized in this method.

Further, Japanese Patent Application Laid-Open No. 2001-325920 has proposed another countermeasure in which, a bump portion is formed at a portion to have the lowest temperature in a bulb toward the outside of the bulb so that heat radiation is locally increased so as to set the temperature of the corresponding portion to the vicinity of 40° C.

In the method using the amalgam, however, in the case when a lamp is turned on from a turn-off state in which the lamp temperature is low, since it takes some time until the amalgam has had a temperature rise to again release the adsorbed mercury, the resulting problem is that it takes not less than several minutes of rising-time to obtain sufficient brightness from the lamp after the turning-on.

Moreover, in the case of a method in which, in order to shorten the rising-time of brightness, without using amalgam, the bump portion is formed on the outer wall of the bulb with mercury droplets being enclosed in the bulb, although the effect for controlling the temperature of the coldest point to the vicinity of 40° C. is obtained, the glass strength of the bump portion tends to weaken to be easily broken. Furthermore, since the incandescent lamp has no bump portion of this type, it is not desirable from the aesthetic viewpoint, when this fluorescent lamp is used in place of an incandescent lamp.

The present invention has been devised to solve the above-mentioned problems, and its main objective is to provide a compact self-ballasted electrodeless discharge lamp which controls the temperature of the coldest point within a desired range by using a technique that is different from the conventional techniques, and an electrodeless-discharge-lamp lighting device.

DISCLOSURE OF THE INVENTION

According to one aspect of the present invention, a first compact self-ballasted electrodeless discharge lamp includes a bulb filled with discharge gas containing mercury and a rare gas; an excitation coil installed near the bulb; a ballast circuit which supplies high frequency power to the excitation coil; and a base that is electrically connected to the ballast circuit, and in this structure, the bulb, the excitation coil, the ballast circuit and the base are formed into an integral part; the bulb has a virtually spherical shape or a virtually ellipsoidal shape; a recessed portion to which the excitation coil is inserted is formed on the ballast circuit side of the bulb; the recessed portion has an opening section on the ballast circuit side, and has a tube shape with a virtually round shape in its cross section, with a portion positioned on the side opposite to the opening section of the recessed portion being provided with a function for suppressing the convection of the discharge gas; the largest diameter of the bulb is set in a range from not less than 60 mm to not more than 90 mm; the bulb wall loading of the bulb during a stable lighting operation is set in a range from not less than 0.07 $W/cm^2$ to not more than 0.11 $W/cm^2$; the ratio (h/D) of the height (h) of the bulb based upon the end face of the opening section in the recessed portion to the largest diameter (D) of the bulb is set in a range from not less than 1.0 to not more than 1.3; and, supposing that a distance between a top face of the recessed portion positioned on the side opposite to the opening section of the recessed portion and a top portion of the bulb facing the top face of the recessed portion is $\Delta h$, and that a diameter of a portion positioned on the side opposite to the opening section of the recessed portion is Dc, the following relationship is satisfied: $\Delta h \leqq 1.15 \times Dc + 1.25$ mm.

In one embodiment of the present invention, the above-mentioned diameter Dc and the above-mentioned distance $\Delta h$ satisfy the following relationship: $\Delta h \geqq 1.16 \times Dc - 7.4$ mm.

The largest diameter of the bulb is preferably set in a range from not less than 65 mm to not more than 80 mm. Moreover, preferably, the bump portion is not formed on the top portion that forms the coldest point of the bulb or in the vicinity thereof.

In another embodiment, the excitation coil is constituted by a core and a coil wound around the core, and the center portion of the portion around which the coil is wound in the longitudinal direction of the core is positioned within a range that is apart from the plane on which the largest diameter of the bulb is located by a distance from not less than 8 mm to not more than 20 mm toward the ballast circuit side.

According to another aspect of the present invention, a second compact self-ballasted electrodeless discharge lamp includes a bulb filled with discharge gas containing mercury and a rare gas; an excitation coil installed near the bulb; a ballast circuit which supplies high frequency power to the excitation coil; and a base that is electrically connected to the ballast circuit, and in this structure, the bulb, the excitation coil, the ballast circuit and the base are formed into an integral part; the bulb has a virtually spherical shape or a virtually ellipsoidal shape; a recessed portion to which the excitation coil is inserted is formed on the ballast circuit side of the bulb; the recessed portion has an opening section on the ballast circuit side, and has a tube shape with a virtually round shape in its cross section, with a portion positioned on the side opposite to the opening section of the recessed portion being provided with a function for suppressing the convection of the discharge gas; the largest diameter of the bulb is set in a range from not less than 55 mm to not more than 75 mm; the bulb wall loading of the bulb during a stable lighting operation is set in a range from not less than 0.05 W/cm2 to less than 0.07 W/cm2; the ratio (h/D) of the height (h) of the bulb based upon the end face of the opening section in the recessed portion to the largest diameter (D) of the bulb is set in a range from not less than 1.0 to not more than 1.3; and, supposing that a distance between a top face of the recessed portion positioned on the side opposite to the opening section of the recessed portion and a top portion of the bulb facing the top face of the recessed portion is $\Delta h$, and that a diameter of a portion positioned on the side opposite to the opening section of the recessed portion is Dc, the following relationship is satisfied: $\Delta h \leqq 1.92 \times Dc - 22.4$ mm.

In one embodiment of the present invention, the above-mentioned diameter Dc and the above-mentioned distance $\Delta h$ satisfy the following relationship: $\Delta h \geqq 1.16 \times Dc - 17.4$ mm.

The largest diameter of the bulb is preferably set in a range from not less than 60 mm to not more than 70 mm.

In another embodiment, the excitation coil is constituted by a core and a coil wound around the core, and the center portion of the portion around which the coil is wound in the longitudinal direction of the core is virtually positioned on a plane within which the largest diameter of the bulb is located.

In still another embodiment, the above-mentioned mercury is enclosed in the bulb not in the form of amalgam but in the form of mercury element.

In still another embodiment, the filling pressure of the rare gas is set in a range from not less than 60 Pa to not more than 300 Pa.

In the other embodiment, a phosphor layer is formed on an inner surface of the bulb.

A first electrodeless-discharge-lamp lighting device in accordance with the present invention includes a bulb that is filled with discharge gas containing mercury and a rare gas, and has a recessed portion; an excitation coil inserted in the recessed portion; and a ballast circuit which supplies high frequency power to the excitation coil, and in this structure, the bulb has a virtually spherical shape or a virtually ellipsoidal shape; the recessed portion has an opening section on the ballast circuit side, and has a tube shape with a virtually round shape in its cross section; the largest diameter of the bulb is set in a range from not less than 60 mm to not more than 90 mm; the bulb wall loading of the bulb during a stable lighting operation is set in a range from not less than 0.07 W/cm2 to not more than 0.11 W/cm2; the ratio (h/D) of the height (h) of the bulb based upon the end face of the opening section in the recessed portion to the largest diameter (D) of the bulb is set in a range from not less than 1.0 to not more than 1.3; and, supposing that a distance between a top face of the recessed portion positioned on the side opposite to the opening section of the recessed portion and a top portion of the bulb facing the top face of the recessed portion is $\Delta h$, and that a diameter of a portion positioned on the side opposite to the opening section of the recessed portion is Dc, the following relationship is satisfied: $\Delta h \leqq 1.15 \times Dc + 1.25$ mm.

According to the other aspect of the present invention, a second electrodeless-discharge-lamp lighting device includes a bulb that is filled with discharge gas containing mercury and a rare gas, and has a recessed portion; an excitation coil inserted in the recessed portion; and a ballast circuit which supplies high frequency power to the excitation coil, and in this structure, the bulb has a virtually spherical shape or a virtually ellipsoidal shape; the recessed portion has an opening section on the ballast circuit side, and has a virtually cylinder shape with a virtually round tube shape in its cross section; the largest diameter of the bulb is set in a range from not less than 55 mm to not more than 75 mm; the bulb wall loading of the bulb during a stable lighting operation is set in a range from not less than 0.05 W/cm2 to less than 0.07 W/cm2; the ratio (h/D) of the height (h) of the bulb based upon the end face of the opening section in the recessed portion to the largest diameter (D) of the bulb is set in a range from not less than 1.0 to not more than 1.3; and, supposing that a distance between a top face of the recessed portion positioned on the side opposite to the opening section of the recessed portion and a top portion of the bulb facing the top face of the recessed portion is Δh, and that a diameter of a portion positioned on the side opposite to the opening section of the recessed portion is Dc, the following relationship is satisfied: $\Delta h \leqq 1.92 \times Dc - 22.4$ mm.

In one embodiment, the diameter Dc of a portion positioned on the side opposite to the opening section of the recessed portion is greater than the diameter of a portion corresponding to virtually the center portion of the recessed portion in the longitudinal direction of the excitation coil.

BEST MODE FOR CARRYING OUT THE INVENTION

The inventors of the present invention have repeated many experiments, and found an optimal range of dimensions of constituent elements inside a lamp, which can control the temperature of the coldest point to a desirable range, without using amalgam, without giving any adverse effects to the appearance of the lamp.

Figure 2:
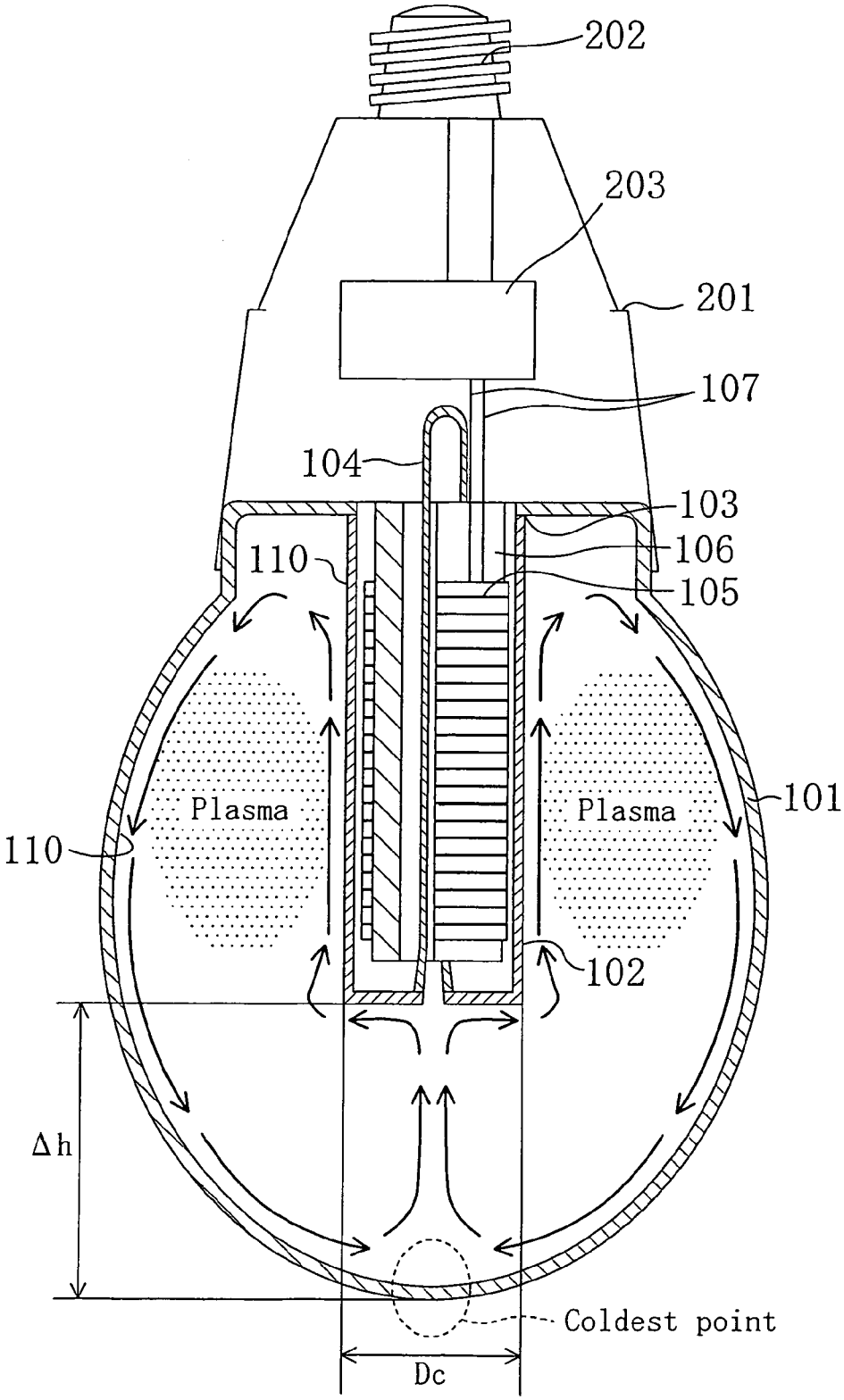
FIG. 2 schematically shows a convection of discharge gas inside the electrodeless discharge lamp.

Referring to FIG. 2, the following description will discuss how the temperature of the coldest point of the bulb is determined during a stable lighting operation. FIG. 2 shows a state in which an electrodeless fluorescent lamp is being lit with "a base (high-frequency power-supply circuit 203 and a base 202) facing up" (hereinafter, this state is referred to as "base-up lighting state"). Normally, an incandescent lamp is used in this base-up lighting state. In FIG. 2, a bulb 101 has a virtually ellipsoidal shape that is similar to an incandescent lamp having an A-type shape defined under JIS C 7710-1988, and is made from light-transmitting glass, for example, soda lime glass. A recessed portion 102, which has a virtually cylinder shape, and is made from the same material as the bulb 101, is melt-bonded to the bulb 101 at its opening end 103. After once evacuated to vacuum through an exhaust pipe 104, the bulb 101 is filled with a small amount of liquid mercury (not shown) and a rare gas, for example, Kr (not shown), that serve as a discharge gas, under a pressure in a range from 60 Pa to 100 Pa at room temperature. Here, mercury is first put into the bulb 101 as Zn—Hg that has no mercury-vapor-pressure controlling function; however, mercury, released from Zn—Hg through high temperatures, is sealed as mercury element in an electrodeless fluorescent lamp that has been once used, without being again adsorbed by Zn—Hg. In other words, although Zn—Hg is a supply source for mercury, mercury is enclosed in the lamp virtually as mercury element. The inner wall face of the bulb 101 is coated with an alumina protective layer (not shown) in order to prevent blackening caused by a reaction between mercury and sodium contained in soda glass, and further coated with a phosphor film (phosphor layer) 110. Moreover, a face of the recessed portion 102 on the bulb 101 side is coated with a visible-light reflection film (not shown) made of alumina, and further coated with the phosphor film (phosphor layer) 110.

An excitation coil (wire) 105, made of a copper stranded wire (litz wire) insulation-coated, is wound around a magnetic core (core) 106 made from Mn—Zn-based soft magnetic ferrite in the form of a solenoid inside the recessed portion 102. The two end lines 107 of the excitation coil 105 are connected to a high-frequency power-supply circuit (ballast circuit) 203 placed inside a housing 201 that is constituted by a resin member with an electric insulating property.

Commercial power-supply electric power, supplied through the base 202 that allows a direct power supply from a usual socket for the incandescent lamp, is converted to a high-frequency current having a frequency of about 400 kHz through the high-frequency power-supply circuit 203, and supplied to the excitation coil 105. By supplying this high-frequency current to the excitation coil 105, an induced electric field (not shown) is generated inside the bulb 101. Electrons in discharge gas are accelerated in this induced electric field and allowed to collide with atoms in a rare gas and mercury so that excitation and ionization are repeated to generate continuous discharging; thus, plasma is generated as shown in FIG. 2.

Here, the frequency of the high-frequency power to be supplied to the excitation coil 105 by the high-frequency power-supply circuit 203 is set to about 400 kHz, which is a low frequency in comparison with 13.56 MHz or several MHz in the ISM band that is practically used in general. The reason for this is because, when operated in a comparatively high frequency range such as 13.56 MHz or several MHz, a large-size noise filter for suppressing line noise generated from the high-frequency power-supply circuit 203 is required to make the volume of the high-frequency power-supply circuit 203 larger. Moreover, in the case when noise, radiated or transmitted from a lamp, forms high-frequency noise, since high-frequency noise is strictly regulated by the act, an expensive shield needs to be used to adjust the noise to the regulation, resulting in a major problem with a cost reduction. In contrast, when operated in a low frequency range from 40 kHz to 1 MHz, inexpensive general products, which are used as electronic parts for general electronic apparatuses, can be used as parts to form the high-frequency power-supply circuit 203, and small-size parts can also be used; thus, great advantages, such as cost reduction and miniaturization, can be achieved. However, not limited to about 400 kHz, the present arrangement can be applied to another frequency area within the range from 40 kHz to 1 MHz and also to a comparatively high frequency area such as 13.56 MHz or several MHz.

In FIG. 2, the portion having the highest temperature inside the bulb 101 is generally a plasma portion in which energy in the induced electric field, derived from the excitation coil 105, is consumed as Joule heating in discharge gas. The heat, generated in this plasma portion, is released from the outer surface of the bulb 101 to outside air. Therefore, the portion that is farthest from the plasma portion in the bulb 101, and made in contact with outside air, that is, the top portion of the bulb 101, forms the coldest point. During a stable lighting state, the temperature of the coldest point is determined when the generating heat quantity is balanced with the heat quantity discharged to outside air. Here, the stable lighting state refers to a state in which, after a lapse of a sufficient period of time since the turning on (normally, from several minutes to several tens of minutes), the heat generation from the plasma portion, excitation coil 105 and high-frequency power-supply circuit 203 and the cooling due to outside air have reached an equilibrium state to make the temperature distribution of the bulb 101 constant so that mercury having a vapor pressure determined by the constant temperature distribution is allowed to contribute to light emission.

Figure 3:
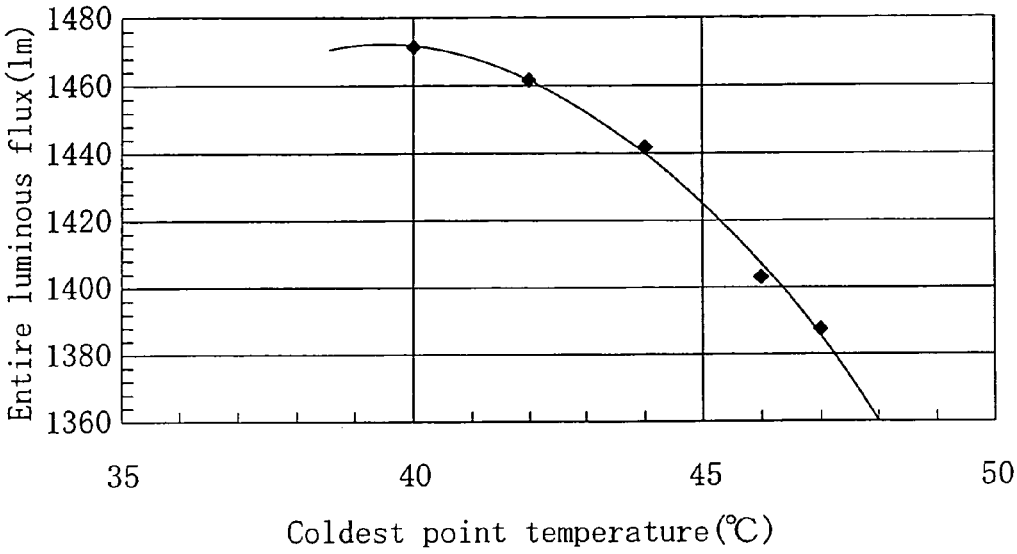
FIG. 3 is a graph that shows a relationship between the coldest point temperature of the electrodeless discharge lamp and entire luminous flux inside the electrodeless discharge lamp.

Next, the following description will discuss how the coldest point temperature gives effects to the lamp efficiency in the electrodeless fluorescent lamp having of such an arrangement. FIG. 3 shows the results of experiments in which a prototype electrodeless fluorescent lamp, as shown in FIG. 2, was actually produced and the coldest point temperature is forcefully controlled while changing the ambient temperature so that the entire luminous flux of the lamp were measured each time. In FIG. 3, the axis of abscissas indicates the temperature (° C.) of the coldest point, and the axis of ordinates indicates the entire luminous flux (lm). Moreover, the electrodeless fluorescent lamp, used in the present experiments, has a structure shown in FIG. 2, in which the largest diameter (D) of the bulb 101 is 75 mm and the height (h) of the bulb 101 measured from the opening end 103 of the recessed portion 102 is 90 mm, with a minute amount of mercury droplets and Kr gas being enclosed in the bulb 101 so as to have a pressure of 80 Pa at room temperature. The largest diameter of the bulb 101 is measured within a plane that is orthogonal to the rotational symmetry axis of the bulb 101, and located on the outer wall side of the bulb 101. The diameter (outer diameter) of the recessed portion 102 is 21 mm, and the height up to the top portion of the recessed portion 102, measured from the opening end 103 of the recessed portion 102, is 58 mm. Since the thickness of the bulb 101 and the recessed portion 102 is about 0.8 mm that is so small that the diameter and the height may be obtained by measuring the inner diameter portion and the like while ignoring the thickness portion as an error, or the corresponding value of each of the diameter and height may be calculated with even the thickness portion being strictly converted. Here, since the recessed portion 102 has a virtually cylindrical shape, virtually the same diameter is obtained at any portion in the recessing direction, and the diameter of the portion positioned on the side opposite to the opening section of the recessed portion 102 is also 21 mm. Moreover, the electric power, supplied through the base 202, is 20 W so that actual input electric power to be supplied to the bulb 101, which includes a loss caused by the high-frequency power-supply circuit 203, is about 18 W. During a lighting operation under such conditions, the electric power per unit surface area in the bulb 101, that is, the bulb wall loading at the time of a stable lighting operation, is about 0.074 W/cm$^2$. Here, upon calculating the bulb wall loading, strictly speaking, the electric power consumed by the plasma in the bulb 101 should be divided by the inner surface area of the bulb 101. However, actually, it is generally difficult to accurately measure the electric power consumption in the plasma. For this reason, in this case, the electric power to be supplied to the excitation coil 105 from the high-frequency power-supply circuit 203, which can be accurately measured, is divided by the inner surface area of the bulb 101, so that the resulting value is referred to as the bulb wall loading.

As clearly shown by FIG. 3, the light-emitting efficiency of the electrodeless fluorescent lamp reaches a maximum value when the coldest point is in the vicinity of 40° C., and as the coldest point temperature rises, the light-emitting efficiency drops abruptly. With respect to the lamp used in these experiments, the coldest point temperature is 47.2° C. at normal temperature, that is, at an ambient temperature of 25° C., with the entire luminous flux being 1380 lm that is 6% or more lower than the maximum value of the entire luminous flux in the case of the coldest point temperature of 40° C. If the temperature at the coldest point is set to at least not more than 46° C.; then it becomes possible to suppress the reduction in the entire luminous flux to within about 5% of the maximum value. Therefore, based upon the inherent mechanism by which the coldest point temperature is determined, the inventors of the present invention have examined the suppressing means for the coldest point temperature.

Upon taking the above-mentioned mechanism into consideration, it is important to clarify how heat is transferred inside the bulb 101, and conventionally, it has been considered that most of the heat transfer inside the bulb 101 is exerted through heat conduction, since the pressure inside the bulb 101 used in the present experiments is 80 Pa that is a small level. In other words, different from the high intensity discharge lamp typically represented by a high-pressure mercury lamp for use in the liquid crystal projector, low-pressure discharge plasma, such as that generated inside a fluorescent lamp, has a very low discharge-gas pressure, that is, a several hundredths of 1 atm; therefore, convection inside the bulb of a fluorescent lamp, which serves as a heat-scattering mechanism, has been conventionally ignored. Under these circumstances, the inventors of the present invention have directed their attention to the convection that has not been considered to contribute to heat transfer.

With respect to the convection inside the bulb 101 of the fluorescent lamp, first, discharge gas inside the bulb 101 is heated at its plasma portion, and is allowed to rise toward the housing 201 side. At an area of the bulb wall of the bulb 101 that contacts outside air, since the discharge gas is cooled due to heat transfer to the outside air, the discharge gas drops from the housing 201 side toward the top of the bulb 101. As a result, it is considered that, during a stable lighting operation, convections, indicated by arrows in FIG. 2, are exerted inside the bulb 101. Therefore, heat generated at the plasma portion is transferred not only by heat conduction due to the discharge gas, but also by these convections so that the heat transfer path from the plasma portion becomes the longest, thereby allowing the portion that contacts the outside air, that is, the top portion of the bulb 101, to form the coldest point as well. It is considered that, during the stable lighting operation, the quantity of heat to be transferred to this coldest point through the heat conduction and convections matches with the quantity of heat to be discharged from the outer surface of the bulb 101 to outside air so that the temperature of the coldest point is determined.

Here, FIG. 2 has explained the base-up lighting operation; however, in the case when the lighting operation is carried out in a reversed direction, that is, in the case of the lighting operation with the housing 201 facing down, although the directions of the convections are reversed, the top portion of the bulb 101, which is far from the plasma portion serving as a heat source, and contacts outside air, is also allowed to form the coldest point in the same manner as the base-up lighting operation. The same is true for the heat transfer path toward the coldest point.

Here, the inventors of the present invention had an idea that it would become possible to control the temperature of the coldest point by preventing the convection from the plasma portion forming the highest temperature portion in the bulb 101 toward the coldest point by using any method.

By using a thermal hydraulic simulation technique so as to confirm the above-mentioned idea, the movements of discharge gas inside the bulb 101 during the stable lighting operation were calculated. As a result, as schematically indicated in the vicinity of the top of the recessed portion 102 of FIG. 2, it was found that the flow of the discharge gas was greatly disturbed in the vicinity of the top of the recessed portion 102. Based upon the results, the inventors had an idea that it would become possible to prevent heat transfer from the plasma portion to the coldest point through the convection by placing the recessed portion 102 closer to the coldest point, and consequently to suppress a temperature rise in the coldest point.

With this idea, a number of prototype electrodeless fluorescent lamps having different lengths in the recessed portion 102, with the size of the bulb 101 being constant, were prepared, and experiments were repeatedly carried out to examine the correlation between the coldest point temperature and the gap Δh between the top of the recessed portion 102 and the top portion of the bulb 101.

Figure 4:
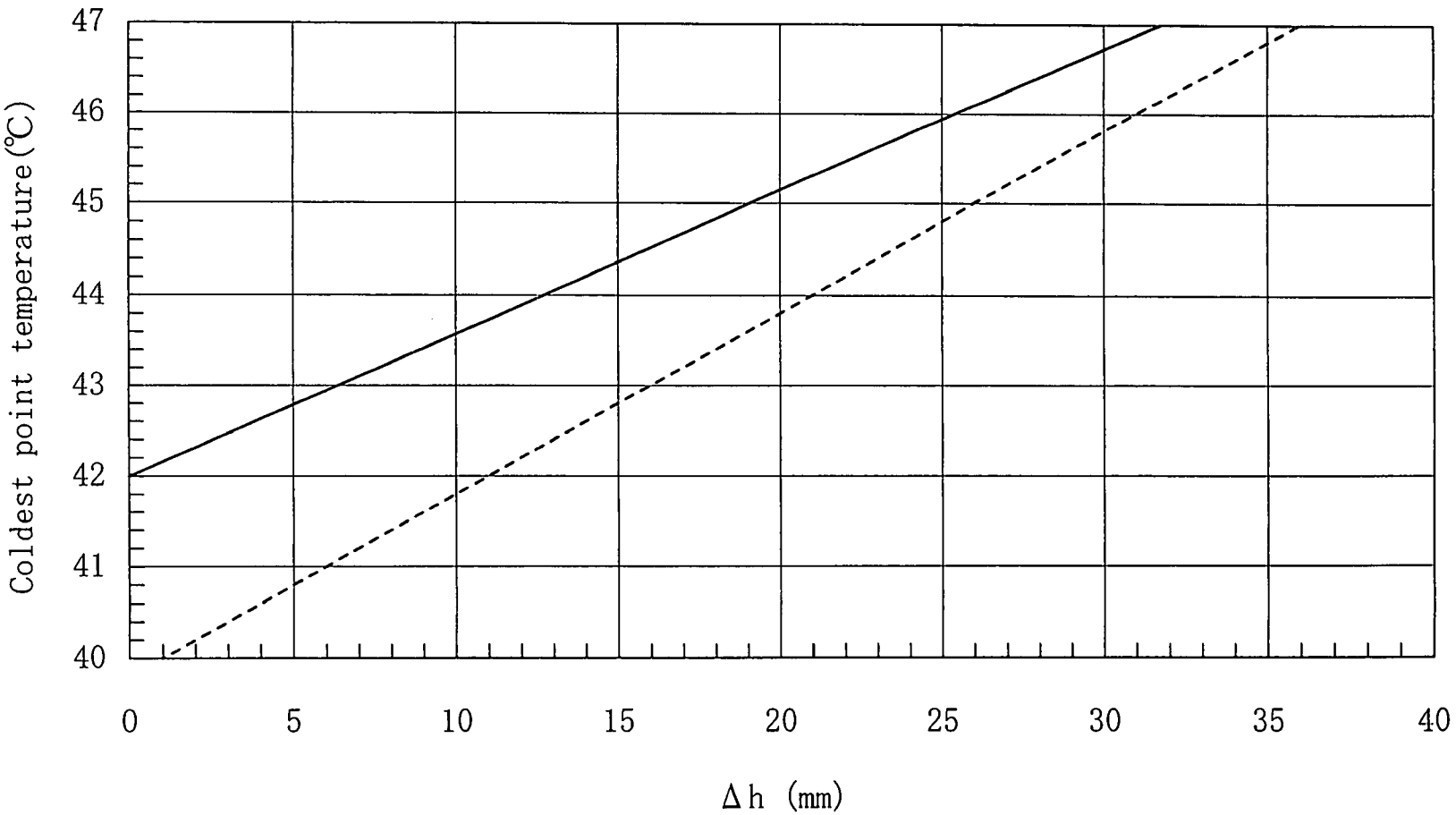
FIG. 4 is a graph that shows a relationship between Δh and the coldest point temperature in the electrodeless discharge lamp.

FIG. 4 shows the experimental results. In FIG. 4, the axis of abscissas indicates Δh, and the axis of ordinates indicates the temperature of the coldest point. Of two lines, one indicated by a solid line shows a case in which the diameter of the recessed portion 102 (vicinity of the top face) is set to 21 mm and the other indicated by a dotted line shows a case in which the diameter of the recessed portion 102 is set to 25.4 mm. As clearly indicated by FIG. 4, as Δh becomes smaller, that is, as the distance between the top portion of the recessed portion 102 and the top of the bulb 101 becomes narrower, the temperature of the coldest point further drops, and as the diameter (vicinity of the top face) of the recessed portion 102 becomes greater, the effects become greater. In other words, it can be said that the vicinity of the top face of the recessed portion 102 (portion positioned on the side opposite to the opening section) has a function for suppressing the convection of discharge gas.

The following description discusses the reason why two kinds of diameters in the recessed portion 102, that is, 21 mm and 25.4 mm, are used in the present experiments. The recessed portion 102 houses an excitation coil 105 and a magnetic core 106 inside thereof, and an exhaust pipe 104 is further placed inside thereof; and in the electrodeless fluorescent lamp of this type as shown in FIG. 2, since no plasma exists upon starting the lamp operation, a current that is ten times higher than that at the time of a stable lighting operation is allowed to flow through the excitation coil 105 so as to start discharging. When such a heavy current flows through the excitation coil 105, a saturation phenomenon takes place inside the magnetic core 106 due to an excessive excited magnetic field in the case when the cross-sectional area of the magnetic core 106 perpendicular to the winding face of the excitation coil 105 is not sufficiently large, with the result that the magnetic core 106 fails to function as a magnetic core. This results in a failure in generating a sufficient induction electric field inside the bulb 101, causing a failure in the lamp starting. For this reason, the diameter of the recessed portion 102 inherently has a lower limit. In contrast, in the case when the diameter of the recessed portion 102 is too large, a space in which plasma is allowed to exist upon lighting, that is, a gap between the recessed portion 102 and the outer wall of the bulb 101, becomes smaller. As a result, the bipolar diffusion loss of plasma increases at this portion, making it difficult to maintain a stable discharging process. Based upon these facts, when the size and power consumption of an electrodeless fluorescent lamp to be used for substituting the normal incandescent lamp are taken into consideration, the diameter of the recessed portion 102, which is practically usable, is considered to be located in a range from 21 mm to 25.4 mm and in the vicinity thereof. Here, it is also possible to use, as the magnetic core 106, materials other than the soft magnetic ferrite, such as a laminated thin silicon steel plate and a dust core, and in this case, there is a possibility that the diameter of the recessed portion 102 can be set to not more than 21 mm.

When, based upon FIG. 4, an area that can set the coldest point temperature to not more than 46° C. is expressed as a relationship between Dc and Δh, the area corresponds to an area located below the relationship indicated by the dotted line of FIG. 6, and is represented by the following expression:

$$\Delta h \leqq 1.15 \times Dc + 1.25 \text{ mm.}$$

Here, since the temperature of the bulb 101 as a whole is generally determined by an input electric power per unit area of the bulb 101, that is, a bulb wall loading, the bulb wall loading becomes greater in an attempt to design an electrodeless fluorescent lamp so as to substitute the incandescent lamp, generally resulting in the above-mentioned problems. Here, since the above-mentioned relationship is prepared between Dc and Δh, it is not necessary to prepare a bump portion for use in cooling on the coldest point, that is, on the top portion of the bulb 101, or in the vicinity thereof; therefore, it is possible to avoid problems, such as a reduction in strength and degradation from the aesthetic viewpoint, caused by the installation of the bump portion.

As explained above, in an attempt to suppress the temperature of the coldest point, it is possible to obtain greater effects by making Δh smaller with an increased value of Dc. In the case when Δh is made further smaller with Dc being made further greater, in order to obtain greater effects, a new problem is raised in that an outline shadow of the recessed portion 102 is formed on the top portion of the bulb 101 and in the vicinity of the coldest point. This adverse effect is caused by the fact that, when viewed from the vicinity of the coldest point, the rate of ultraviolet discharged from the plasma portion being blocked by the top portion of the recessed portion 102 becomes greater as Δh becomes smaller, or as Dc becomes greater.

In order to also examine the relationship between Δh and Dc that can minimize this adverse effect, the inventors of the present invention prepared many electrodeless fluorescent lamps having different values in Δh and Dc, and measured the luminance of each of these lamps at the brightest portion of the side face of the bulb 101 as well as at the portion having the shadow in the vicinity of the coldest portion; thus, experiments were carried out so as to examine the relationship between the intensity of the shadow and Δh as well as Dc. Supposing that the luminance on the side face of the bulb 101 is Ss and that the luminance on the top portion of the bulb 101 to have the shadow is St, the contrast in brightness is defined by the following expression, and FIG. 5 shows the relationship between Δh and the contrast:

$$C=(Ss-St)/(Ss+St)$$

Figure 5:
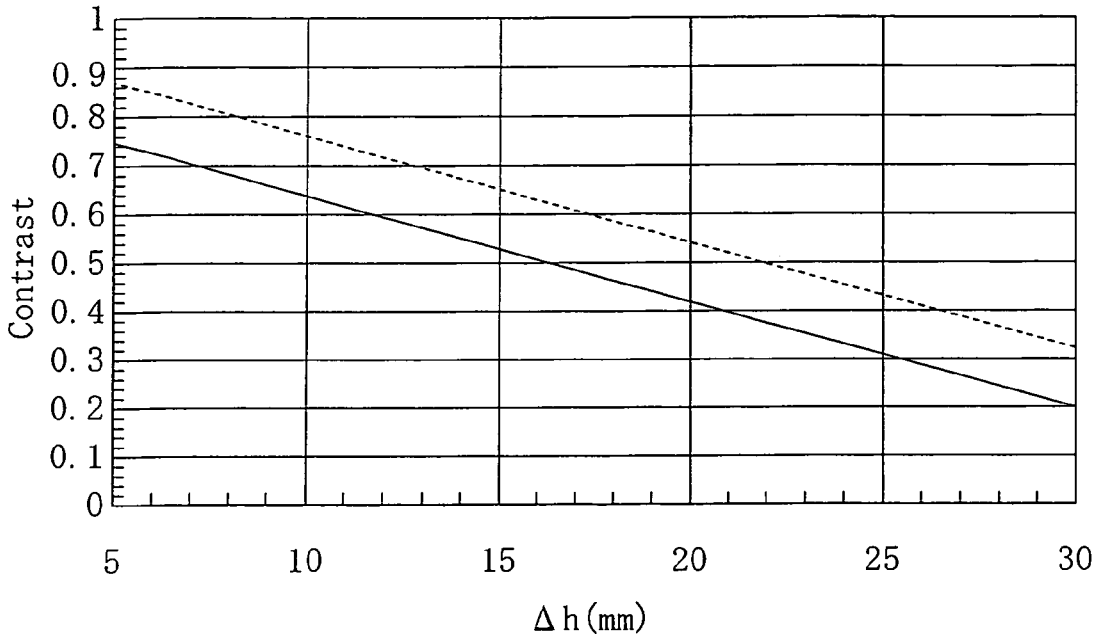
FIG. 5 is a graph that shows a relationship between Δh and the contrast of a profile of a recessed portion in the electrodeless discharge lamp.

In FIG. 5, the axis of abscissas indicates Δh, and the axis of ordinates indicates the contrast as defined by the above-mentioned expression; thus, as the value of the contrast becomes greater, the difference in brightness between the side face of the bulb 101 and the top portion thereof becomes greater, that is, the shadow becomes conspicuous. The result indicated by a solid line shows a case in which Dc is set to 21 mm, and the result indicated by a dotted line shows a case in which Dc is set to 25.4 mm. As shown by FIG. 5, as Δh becomes smaller, or as Dc becomes greater, the value of contrast becomes greater, making the influence of the outline shadow more conspicuous.

Here, subjective evaluation tests were carried out to find out what degree of contrast would cause discomfort to the user, and the results showed that the value of contrast in a degree of 0.7 caused discomfort to two examinees out of eight.

Figure 6:
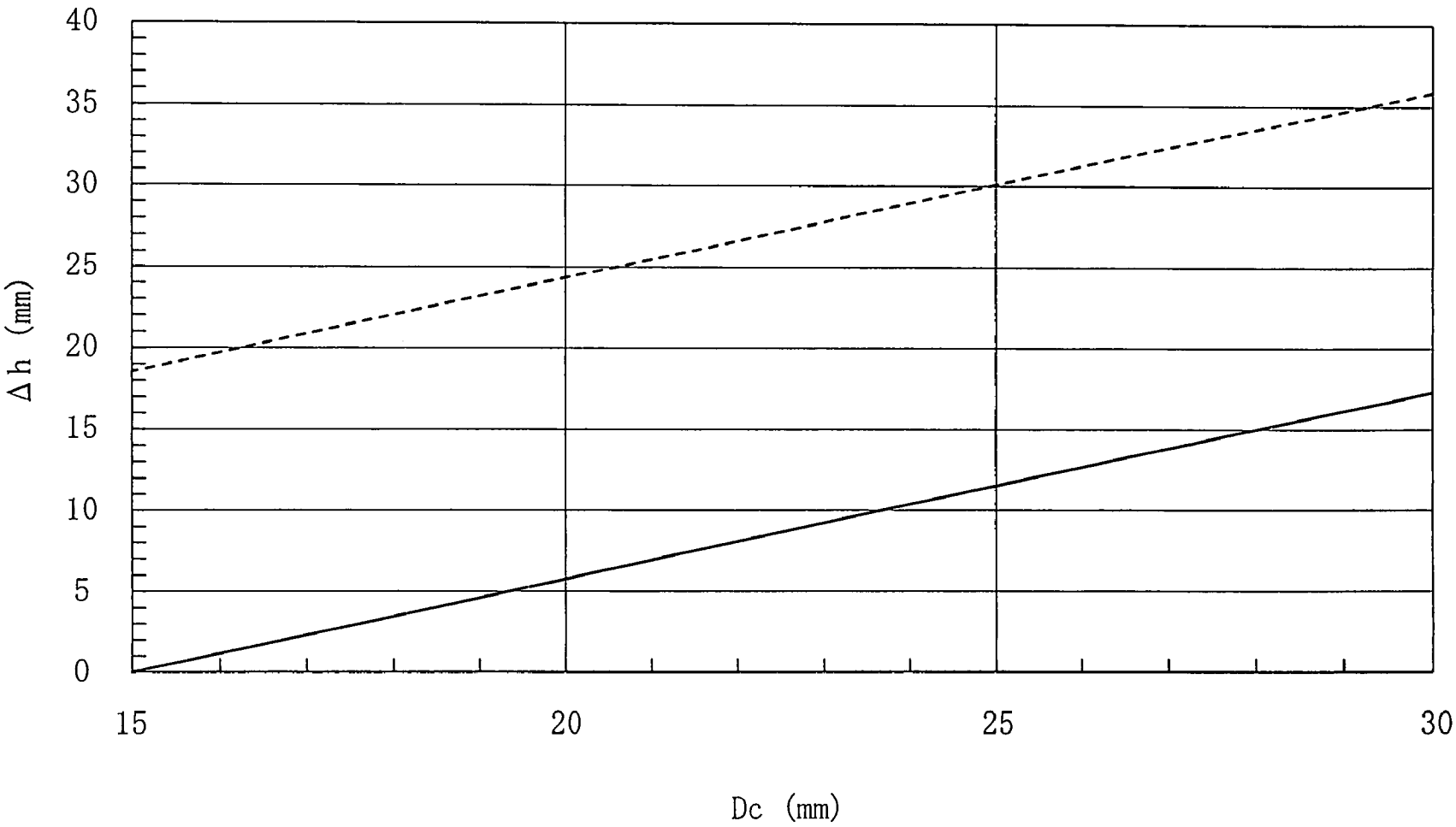
FIG. 6 is a graph that shows a desirable range of Δh and Dc in an electrodeless discharge lamp of a high-watt type in accordance with the present invention.

The solid line of FIG. 6 shows an area that can set the contrast value to not more than 0.7 as a relationship between Δh and Dc, and an area above this line makes it possible to suppress the influence of the outline shadow of the recessed portion 102 to a minimum level. This area is represented by the following expression:

$$\Delta h \geqq 1.16 \times Dc - 17.4 \text{ mm.}$$

Based upon the above-mentioned relationships, the designing process is carried out so that Δh and Dc can satisfy the relationship within the area enclosed by the dotted line and the solid line of FIG. 6; thus, it is possible to obtain a preferable lamp efficiency while suppressing the coldest point temperature to not more than 46° C., with the influence of the outline shadow of the recessed portion 102 being reduced to a minimum level in appearance.

Here, the importance of suppressing the influence of the outline shadow of the recessed portion 102 is also dependent on the state of use of the electrodeless fluorescent lamp at the time of the actual operation. For example, in the case when the lamp is used inside a device provided with a diffusion plate at the opening section, or in the case when the lamp is placed at a position below the human line of sight, the influence of the outline shadow is not so important. For this reason, the conditions for minimizing the influence of the outline shadow of the recessed portion 102 are not necessarily essential.

Figure 12:
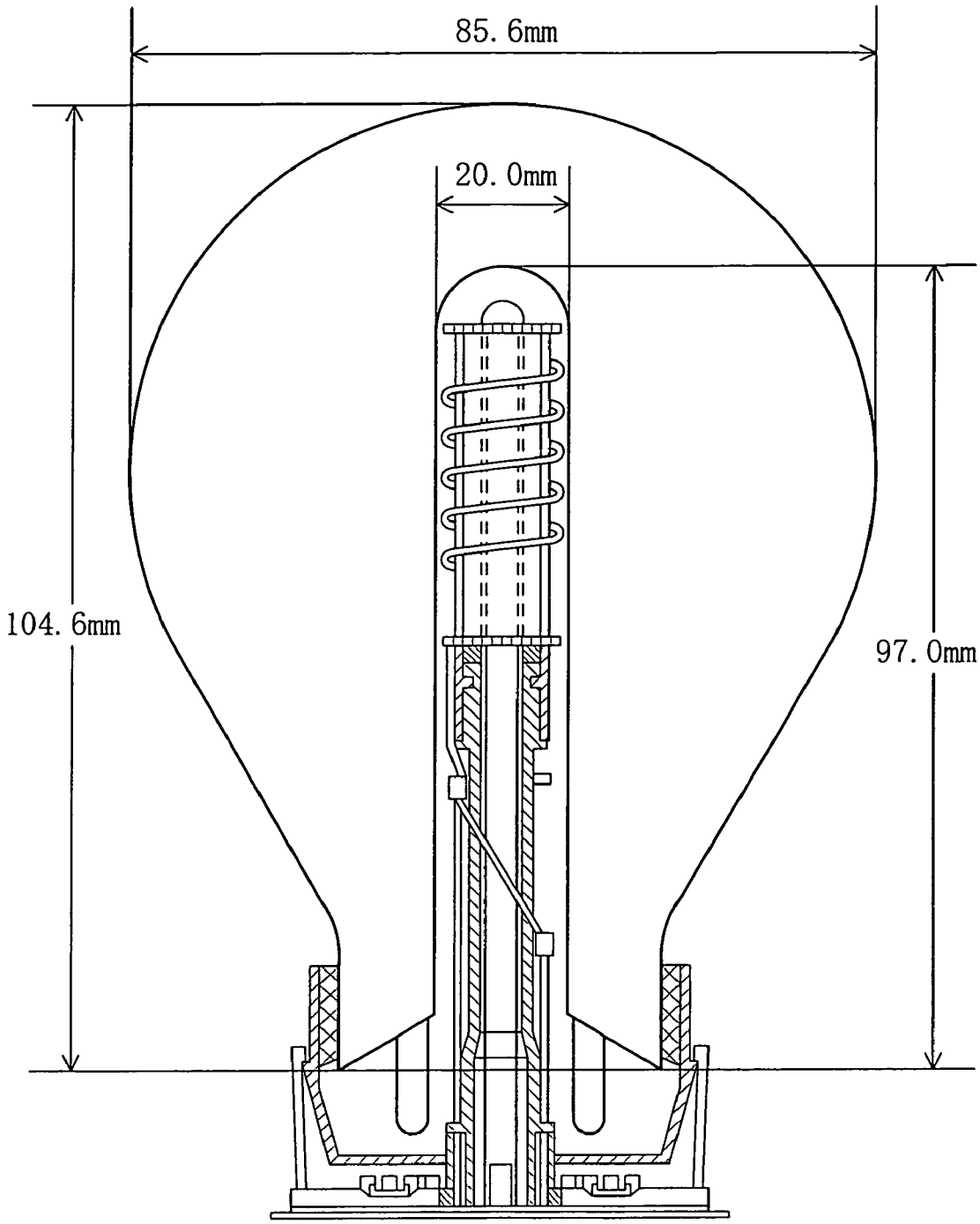
FIG. 12 PRIOR ART
FIG. 12 shows one example of a known electrodeless fluorescent lamp.
Figure 13:
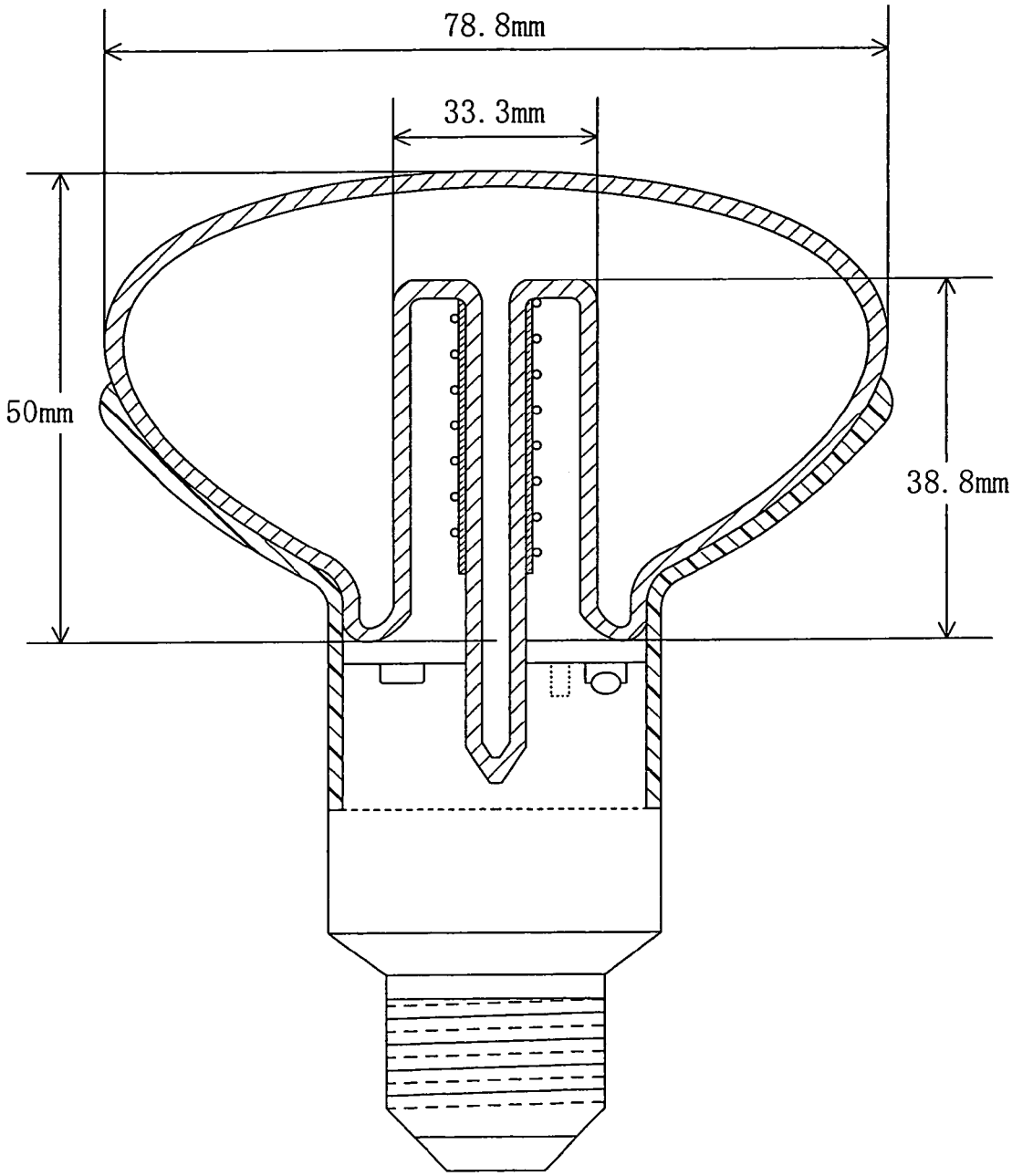
FIG. 13 PRIOR ART
FIG. 13 shows another example of a known electrodeless fluorescent lamp.

Here, in the case of conventionally known electrodeless fluorescent lamps such as those disclosed in U.S. Pat. No. 5,291,091 shown in FIG. 12 and U.S. Pat. No. 5,825,130 shown in FIG. 13, the shapes of these fail to satisfy the above-mentioned two expressions.

Next, the inventors of the present invention directed their attention to the generation position of plasma so as to improve the light-emitting efficiency. In other words, when the center portion for the plasma generation is too close to the housing 201, ambipolar diffusion becomes stronger on the bulb wall of the bulb 101 to cause an increase in electric power to be consumed so as to maintain plasma, resulting in a reduction in the efficiency. In contrast, when the center portion for the plasma generation is too close to the coldest point, the effect for suppressing the convection of the recessed portion 102 is cancelled to cause an increase in the coldest point temperature, resulting in a reduction in the efficiency. The center portion for the plasma generation is considered to virtually correspond to the center portion in the longitudinal direction of a portion of the magnetic core 106 on which the excitation coil 105 is wound around; thus, it is estimated that, when this portion is made coincident with the portion forming the maximum diameter of the bulb 101, the loss due to bipolar diffusion on the bulb wall is minimized.

Figure 11:
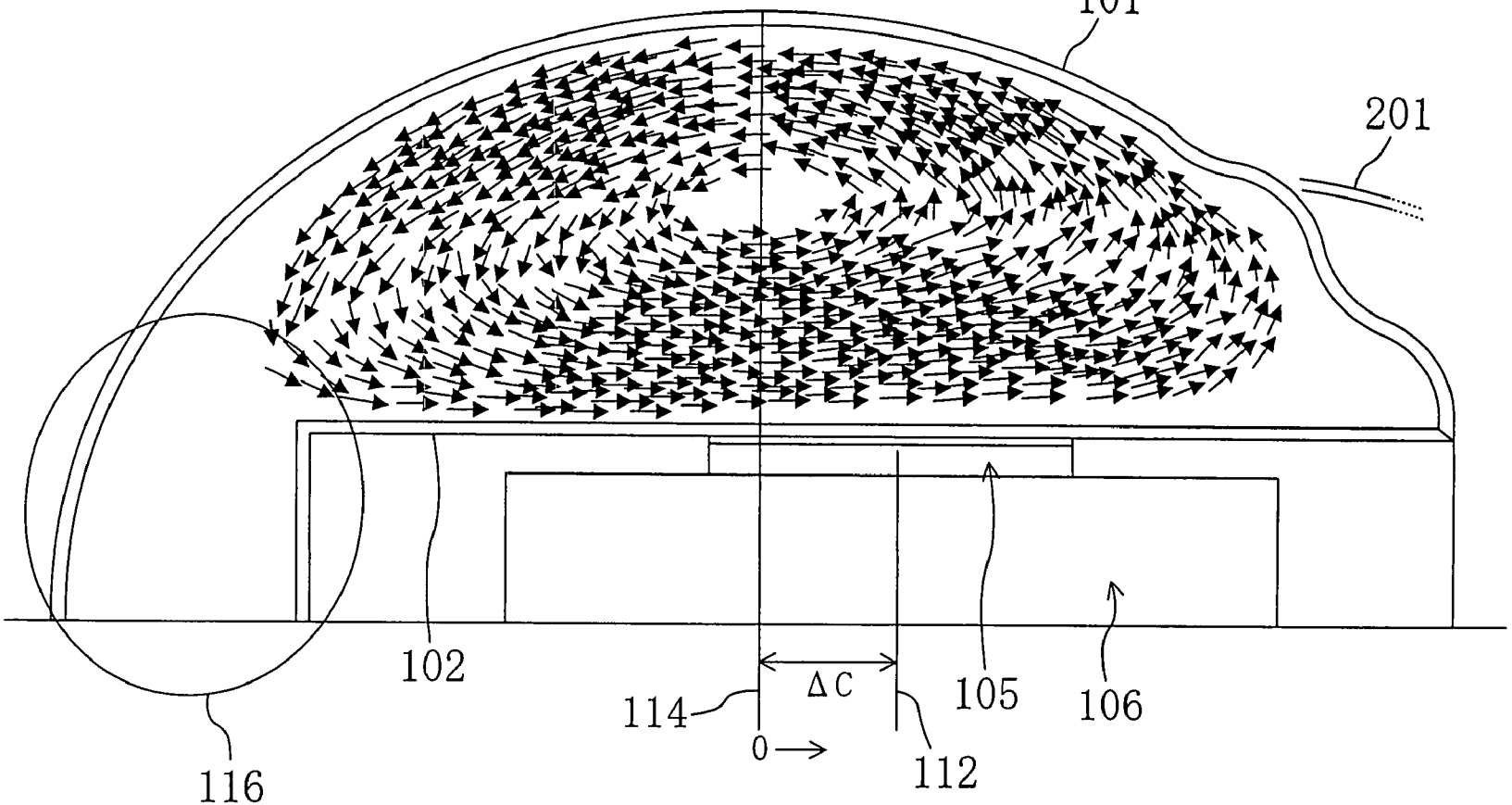
FIG. 11 schematically shows a flow of gas inside the bulb obtained through computer simulation.

FIG. 11, which shows the results of computer simulation carried out on gas flows inside the bulb 101, is a drawing that shows one-half of the longitudinal cross-section of the bulb 101. The flows of gas are indicated by arrows. With respect to the distance ΔC mm between the center portion 112 in the longitudinal direction of the winding face of the excitation coil 105 and the largest diameter portion 114 of the bulb 101, the side proceeding from the largest diameter portion 114 toward the base side is defined as the minus side. In this figure, ΔC=−8 mm. As clearly shown by the figure, the gas flows form a vertex centered on a portion that is located in the middle of the recessed portion 102 and the bulb 101, and corresponds to the largest diameter portion 114 of the bulb 101. These flows proceed toward the housing 201 along the recessed portion 102, turn toward the inner wall side of the bulb 101 from the recessed portion 102 at a corner on which the housing 201 overlaps the bulb 101, and then proceed toward the top portion (coldest point) of the bulb 101 along the inner wall of the bulb 101. The flows turn toward the recessed portion 102 from the inner wall of the bulb 101 at a corner corresponding to the top of the recessed portion 102, and then proceed toward the housing 201 side again along the recessed portion 102.

In this case, in FIG. 11, since Dc and Δh satisfy the following relationship: Δh≦1.15×Dc+1.25 mm, the gas flows do not enter an area 116 located between the top of the recessed portion 102 and the top portion of the bulb 101. In other words, the flows of the high-temperature gas are not allowed to reach the coldest point so that the effect of convection control by the recessed portion 102 is properly exerted.

Figure 9:
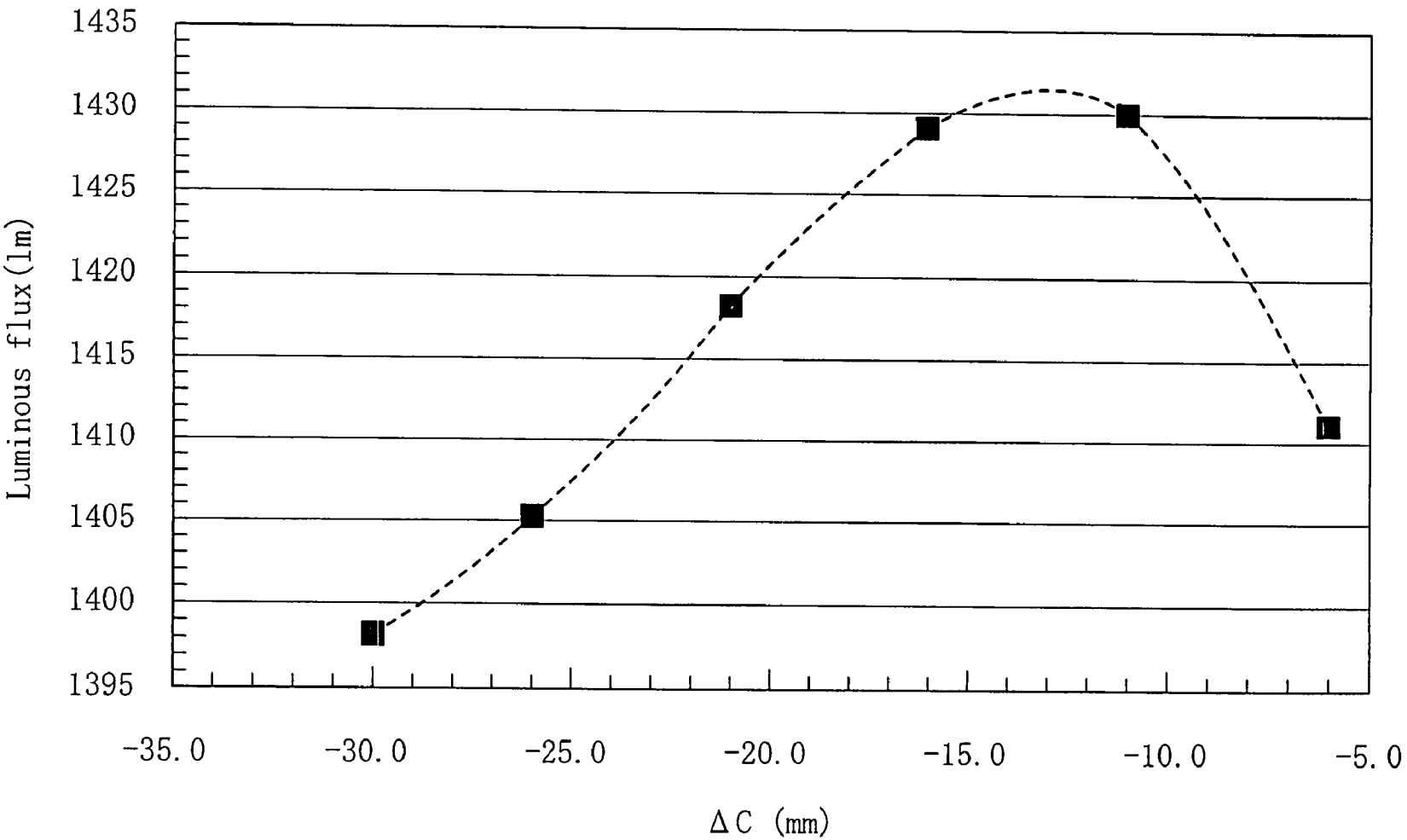
FIG. 9 is a graph that shows a relationship between a difference ΔC between a center position of wound excitation coil and the largest diameter position of the bulb and luminous flux in the electrodeless discharge lamp of a high-watt type.

The above-mentioned simulation relates to the gas flow, and in a separate manner from this, in order to find out a plasma generation position having the best light-emitting efficiency in accordance with the above-mentioned assumption, experiments were carried out, with the winding position of the excitation coil 105 to the magnetic core 106 being changed in various manners. As a result, the relationship shown in FIG. 9 was obtained between the distance ΔC from the center portion 112 in the longitudinal direction of the winding face of the excitation coil 105 to the largest diameter portion 114 of the bulb 101 and the entire luminous flux of the lamp. As clearly indicated by this figure, when ΔC is in a range from −8 to −30 mm, it is possible to obtain desirable light-emitting efficiency that causes no problems in practical use. When ΔC is in a range from −12 to −16 mm, the light-emitting efficiency becomes greater, which is preferable, and when ΔC is −14 mm, the luminous flux becomes the greatest and the light-emitting efficiency becomes best, which is more preferable. Here, different from the above-mentioned assumption, the reason why luminous flux does not become greatest in the case of ΔC=0 mm is that, when the center of the winding position of the excitation coil comes closer to the coldest point due to an increased value of ΔC greater than −14 mm, the high-temperature gas approaches the coldest point to cause a temperature rise in the coldest point because of a great bulb wall loading,5 resulting in degradation in the efficiency. Since the relationships between Dc and Δh as well as the winding position of the excitation coil 105 onto the magnetic core 106, which have not been taken into consideration conventionally, are taken into consideration so as to optimize the efficiency, the winding position of the excitation coil 105 onto the magnetic core 106 is shifted toward the minus side from the largest diameter portion 114 of the bulb 101.

The electrodeless fluorescent lamp that has been explained above is a so-called high-watt type lamp corresponding to an incandescent lamp of 100 W; however, with respect to an electrodeless fluorescent lamp that is a so-called low-watt type lamp corresponding to an incandescent lamp of 60 W, since the lamp of this type has a size and a bulb wall loading that are different from those of the high-watt type lamp, the relationship between Dc and Δh was examined in a separate manner. The following description will discuss the electrodeless fluorescent lamp of the low-watt type.

The electrodeless fluorescent lamp of the low-watt type has virtually the same shape as that of the high-watt type, as shown in FIG. 2. The largest diameter (D) of the bulb 101 is 65 mm and the height (h) of the bulb 101 measured from the opening end 103 of the recessed portion 102 is 72 mm, with a minute amount of mercury droplets and Kr gas being enclosed in the bulb 101 so as to have a pressure of 80 Pa at room temperature. The diameter (represented by an outer diameter that contacts the plasma portion) of the recessed portion 102 is 21 mm, and the height up to the top portion of the recessed portion 102, measured from the opening end 103 of the recessed portion 102, is 58 mm. Moreover, the electric power, supplied through the base 202, is 12 W so that actual input electric power to be supplied to the bulb 101, which includes the loss caused by the high-frequency power-supply circuit 203, is about 11 W. Upon lighting under such conditions, the electric power per unit surface area, that is, the bulb wall loading at the time of a stable lighting operation is about 0.06 W/cm$^2$.

Figure 7:
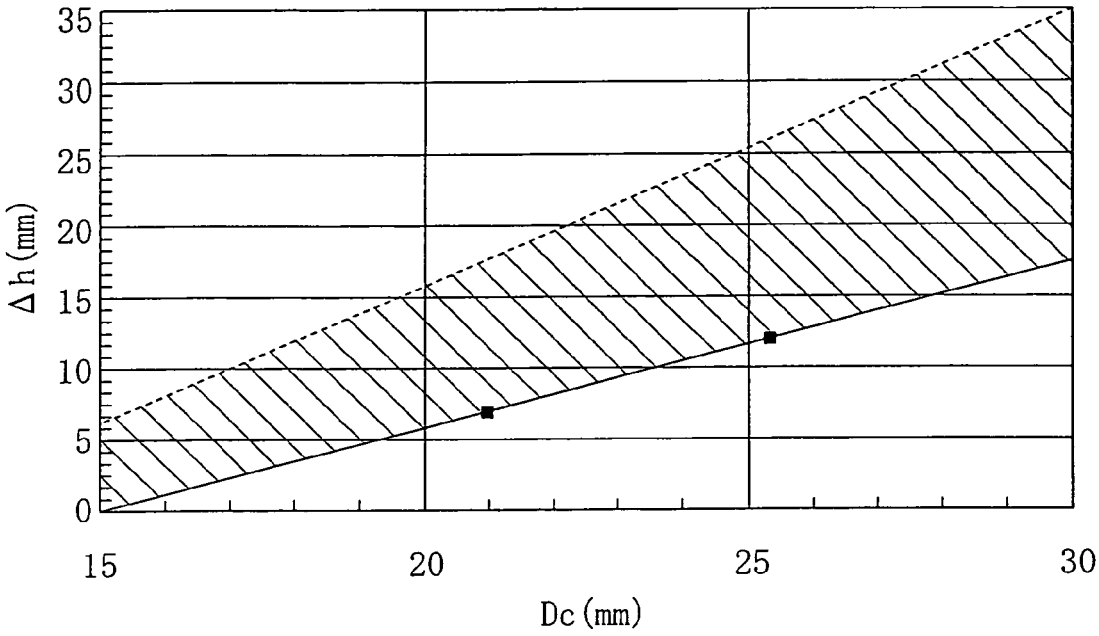
FIG. 7 is a graph that shows a desirable range of Δh and Dc in an electrodeless discharge lamp of a low-watt type in accordance with the present invention.

In the same manner as the lamp of the high-watt type, experiments were also carried out on those of the low-watt type so as to examine the cold point temperature and the influence of the outline shadow of the recessed portion 102 at the top portion of the bulb 101, as well as the relationship between Δh and Dc. The resulting desirable range of Δh and Dc corresponds to an area sandwiched by two straight lines in FIG. 7. Here, since the detailed explanation of FIG. 7 is the same as that of FIG. 6, it is omitted in this case. A desirable relationship between Δh and Dc, obtained from this figure, is represented by the following expressions:

$$\Delta h \leqq 1.92 \times Dc - 22.4 \text{ mm},$$

and $$\Delta h \geqq 1.16 \times Dc - 17.4 \text{ mm}.$$

Figure 10:
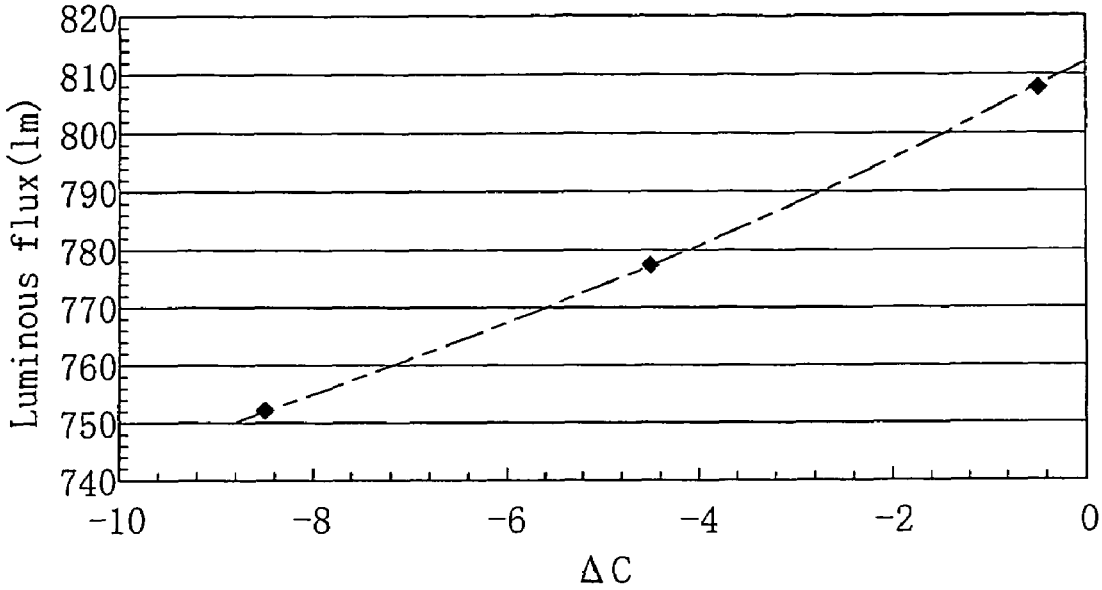
FIG. 10 is a graph that shows a relationship between a difference ΔC between a center position of wound excitation coil and the largest diameter position of the bulb and luminous flux in the electrodeless discharge lamp of a low-watt type.

Moreover, experiments were carried out, with the winding position of the excitation coil 105 onto the magnetic core 106 being changed in various manners; thus, the relationship shown in FIG. 10 was obtained between the distance AC from the center portion 112 in the longitudinal direction of the winding face of the excitation coil 105 to the largest diameter portion 114 of the bulb 101 and the entire luminous flux of the lamp. As clearly indicated by this figure, when ΔC is set to virtually 0 mm, the luminous flux becomes the greatest and the light-emitting efficiency becomes best, which is preferable. Here, in the case of the lamp of the low-watt type, different from the lamp of the high-watt type, since the bulb wall loading is smaller, the luminous flux becomes the greatest, when $$\Delta C = 0 \text{ mm}.$$

The following description will discuss structures of an electrodeless fluorescent lamp corresponding to an incandescent lamp of 100 W in power consumption and an electrodeless fluorescent lamp corresponding to an incandescent lamp of 60 W in power consumption in detail. However, the present invention is not limited to these structures.

<Electrodeless Fluorescent Lamp Corresponding to an Incandescent Lamp for Use in 100 W>

Figure 1:
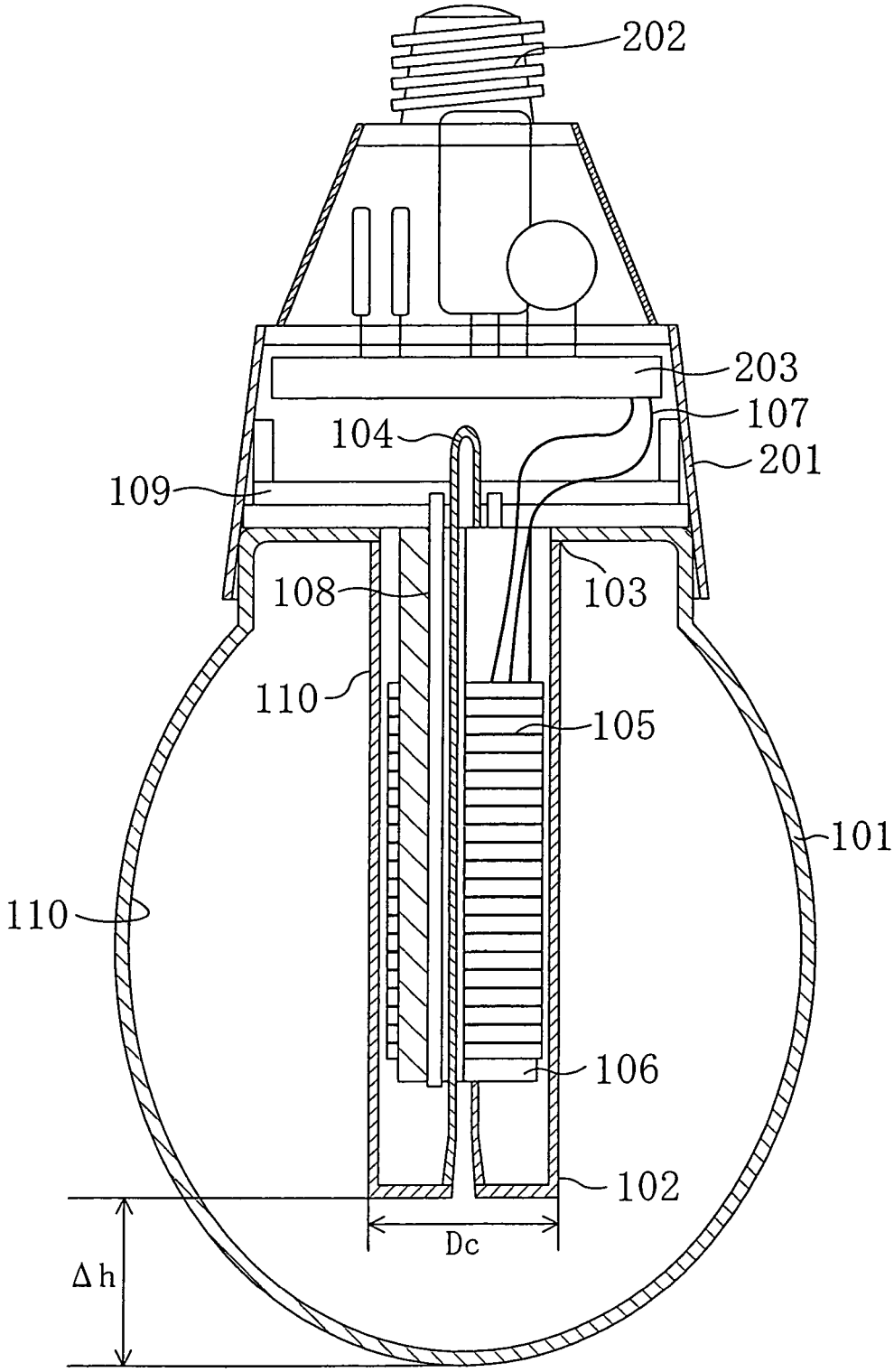
FIG. 1 schematically shows an electrodeless fluorescent lamp in accordance with one preferred embodiment of the present invention.

FIG. 1 shows one example of a preferred embodiment of an electrodeless fluorescent lamp in accordance with the present invention. Those constituent elements that have the same structures as those explained by reference to FIG. 2 are indicated by the same reference numerals, and the description thereof is omitted.

In FIG. 1, a bulb 101, an induction coil constituted by an excitation coil (wire) 105 and a magnetic core (core) 106, a high-frequency power-supply circuit (ballast circuit) 203 and a base 202 are formed into an integral part, and the bulb 101 has a virtually spherical shape or a virtually ellipsoidal shape, and a recessed portion 102 to which the induction coil is inserted is formed on the high-frequency power-supply circuit 203 side of the bulb 101, and the recessed portion 102 has an opening section on the high-frequency power-supply circuit 203 side, and has a virtually cylinder shape, with a portion (top portion) positioned on the side opposite to the opening section of the recessed portion 102 being provided with a function for suppressing the convection of the discharge gas. Further, a radiating tube 108 made of metal, preferably, copper or aluminum that has high heat conductivity, is placed inside the magnetic core 106, and this radiating tube 108 is connected to a radiating member 109 that is made of copper or aluminum in the same manner. With this arrangement, it becomes possible to maintain the magnetic core 106 and the excitation coil 105 at low temperatures during a lighting operation. A commercial electric power, supplied through the base 202 that is directly connectable to a general incandescent-lamp-use socket, is converted to a high-frequency current having a frequency of 400 kHz through the high-frequency power supply circuit 203, and applied to the excitation coil 105 through both of the end wires 107 of the excitation coil 105. Moreover, in order to reduce an eddy current generated in the radiating member 109, a space is formed between the radiating member 109 and the uppermost portion in the magnetic core 106 shown in the figure. The electric power to be consumed in the entire lamp through the base 202 is 20 W, and this electric power is desirable for use in a compact self-ballasted fluorescent lamp for substituting an incandescent lamp of 100 W in power consumption. When the loss in the high-frequency power-supply circuit 203 is taken into consideration, the bulb wall loading in the bulb 101 is about 0.085 $W/cm^2$.

In this example, the largest diameter (D) of the bulb 101 is 70 mm, the height (h) of the bulb 101 measured from the opening end 103 of the recessed portion 102 is 80 mm, the diameter Dc of the recessed portion 102 is 23 mm, and Δh is 15 mm; thus, this structure is located in the area between the two straight lines, shown in FIG. 6, that have been described earlier. In other words, the following relationships are satisfied:

$$\Delta h \leqq 1.15 \times Dc + 1.25 \text{ mm},$$

and $$\Delta h \ 1.16 \times Dc - 17.4 \text{ mm}.$$

Consequently, it becomes possible to suppress the coldest point temperature to not more than 46° C., while reducing the influence of the outline shadow of the recessed portion 102 to a minimum. Here, since the recessed portion 102 has a virtually cylinder shape, virtually the same diameter is obtained at any portion in the recessed direction, and the diameter of the portion positioned on the side opposite to the opening section of the recessed portion 102 is also 23 mm. Moreover, the distance AC from the center portion in the longitudinal direction of the winding face of the excitation coil 105 of the magnetic core 106 to the largest diameter portion of the bulb 101 is set in a range from −14 mm ±2 mm, more preferably, from −14 mm ±1 mm; thus, it becomes possible to increase the light-emitting efficiency, with the coldest point temperature and the resistance of plasma being controlled in a well-balanced manner.

In this example, while the shape and size that are similar to the incandescent lamp corresponding to 100 W are maintained, the diameter Dc of the recessed portion 102 and the distance Δh between a top face of the recessed portion 102 and a top portion of the bulb 101 opposing thereto are allowed to have a fixed relationship; thus, the coldest point temperature of the electrodeless fluorescent lamp can be controlled so that it becomes possible to improve the light-emitting efficiency without using amalgam. Moreover, since the center portion in the longitudinal direction of the winding face of the excitation coil 105 is placed within a constant distance range from the largest diameter portion of the bulb 101, it becomes possible to improve the light-emitting efficiency. In other words, in the compact self-ballasted electrodeless discharge lamp to be used for substituting an incandescent lamp, in accordance with the embodiment of the present invention, by providing a fixed relationship between the diameter of the recessed portion and the distance between the top of the recessed portion and the top portion of the bulb, it becomes possible to control the temperature of the coldest point, while maintaining the appearance and the size that are similar to the incandescent lamp. With this arrangement, it is possible to eliminate the necessity of using amalgam and to provide a compact self-ballasted electrodeless discharge lamp that can improve both the rising-time up to sufficient brightness and the lamp efficiency.

<Electrodeless Fluorescent Lamp Corresponding to an Incandescent Lamp for Use in 60 W>

Figure 8:
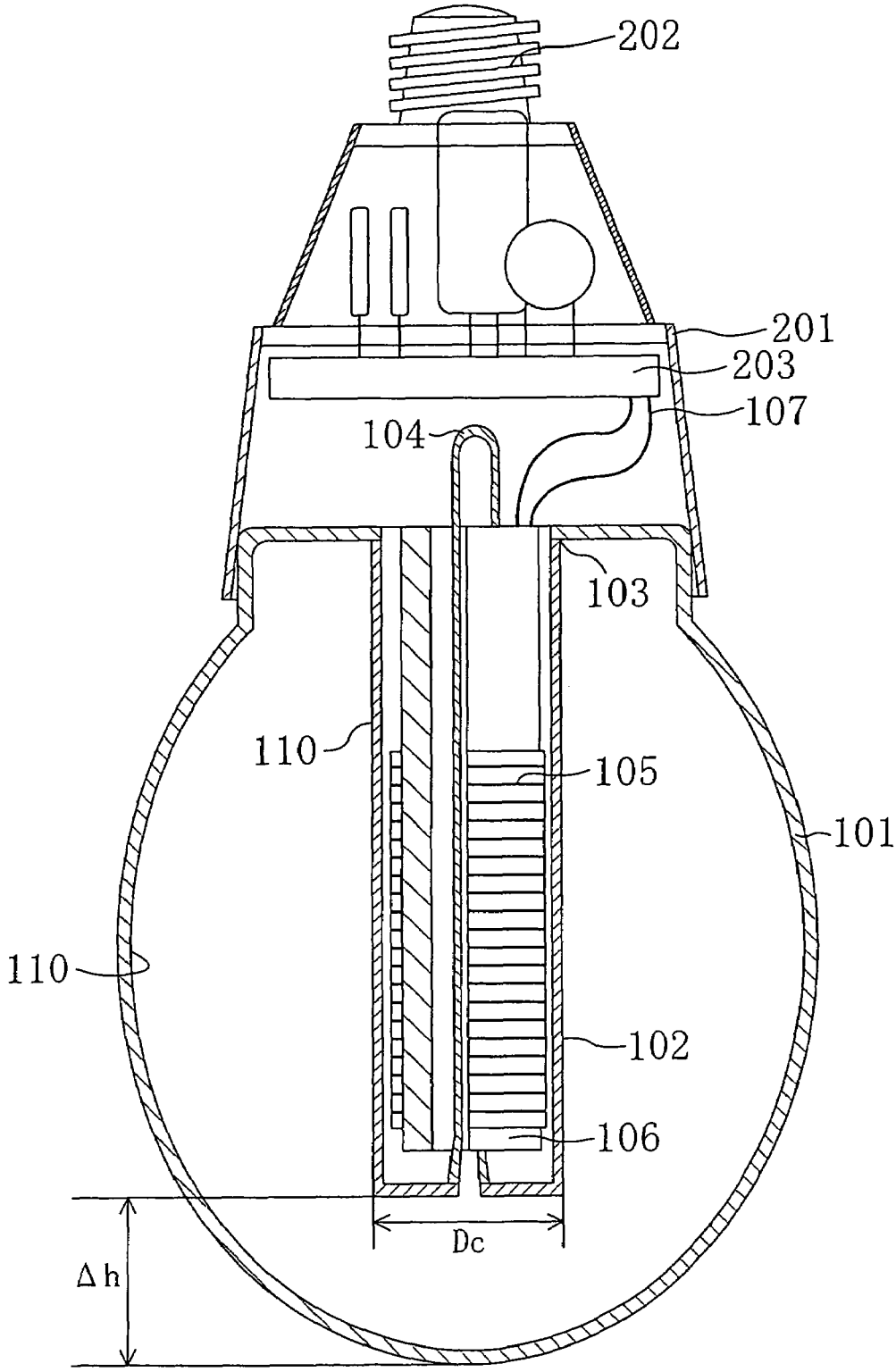
FIG. 8 schematically shows an electrodeless fluorescent lamp in accordance with another preferred embodiment of the present invention.

FIG. 8 shows one example of another preferred embodiment in accordance with the present invention. In FIG. 8, a bulb 101, an induction coil constituted by an excitation coil (wire) 105 and a magnetic core (core) 106, a high-frequency power-supply circuit (ballast circuit) 203 and a base 202 are formed into an integral part, and the bulb 101 has a virtually spherical shape or a virtually ellipsoidal shape, and a recessed portion 102 to which the induction coil is inserted is formed on the high-frequency power-supply circuit 203 side of the bulb 101, and the recessed portion 102 has an opening section on the high-frequency power-supply circuit 203 side, and has a virtually cylinder shape, with a portion (top portion) positioned on the side opposite to the opening section of the recessed portion 102 being provided with a function for suppressing the convection of the discharge gas; thus, this embodiment provides a preferable structure that serves as a compact self-ballasted fluorescent lamp that corresponds to an incandescent lamp of 60 W in power consumption. In this embodiment, the largest diameter (D) of the bulb 101 is set to 65 mm, and the height (h) of the bulb 101 measured from the opening end 103 of the recessed portion 102 is set to 72 mm; thus, a small-size lamp is prepared so as to be suitably applied to a lamp with small power consumption. The electric power to be supplied to the entire lamp through the base 202 is 11 W. When the loss in the high-frequency power-supply circuit 203 is taken into consideration, the bulb wall loading in the bulb 101 is about 0.06 $W/cm^2$. Moreover, since the power consumption becomes smaller, the radiating tube 108 and radiating member 109, made of metal, are not used. However, in the case when there is a possibility of a temperature rise depending on conditions of use, such as use inside a small-size lighting tool or the like, these members may be used.

In the present embodiment, the diameter Dc of the recessed portion 102 is 21 mm, and Δh is 12 mm; thus, this structure is located in the area between the two straight lines, shown in FIG. 7. In other words, the following relationships are satisfied:

$$\Delta h \leqq 1.92 \times Dc - 22.4 \text{ mm},$$

and $$\Delta h \geqq 1.16 \times Dc - 17.4 \text{ mm}.$$

Consequently, it becomes possible to suppress the coldest point temperature to not more than 45° C., while reducing the influence of the outline shadow of the recessed portion 102 to a minimum. Moreover, the distance ΔC from the center portion in the longitudinal direction of the winding face of the excitation coil 105 of the magnetic core 106 to the largest diameter portion of the bulb 101 is set in a range from 0 mm±2 mm, more preferably, from 0 mm±1 mm. In other words, since the bulb wall loading is smaller in comparison with the lamp for use in 100 W, it becomes possible to desirably control the coldest point temperature at a position of ΔC=0 mm where the resistance of plasma is minimized, and consequently to increase the light-emitting efficiency.

In the present embodiment, while the shape and size that are similar to the incandescent bulb corresponding to 60 W are maintained, the diameter Dc of the recessed portion 102 and the distance Δh between a top face of the recessed portion 102 and a top portion of the bulb 101 opposing thereto are allowed to have a fixed relationship; thus, the coldest point temperature of the electrodeless fluorescent lamp can be controlled so that it becomes possible to improve the light-emitting efficiency without using amalgam. Moreover, since the center portion in the longitudinal direction of the winding face of the excitation coil 105 is made virtually coincident with the largest diameter portion of the bulb 101, it becomes possible to improve the light-emitting efficiency. In other words, in the compact self-ballasted electrodeless discharge lamp to be used for substituting an incandescent bulb of 60 W in accordance with the embodiment of the present invention, by providing a fixed relationship between the diameter of the recessed portion and the distance between the top of the recessed portion and the top portion of the bulb, it becomes possible to control the temperature of the coldest point, while maintaining the appearance and the size that are similar to the incandescent bulb. With this arrangement, it is possible to eliminate the necessity of using amalgam and to provide a compact self-ballasted electrodeless discharge lamp that can improve both the rising-time up to sufficient brightness and the lamp efficiency.

<Modified Mode>

Figure 14:
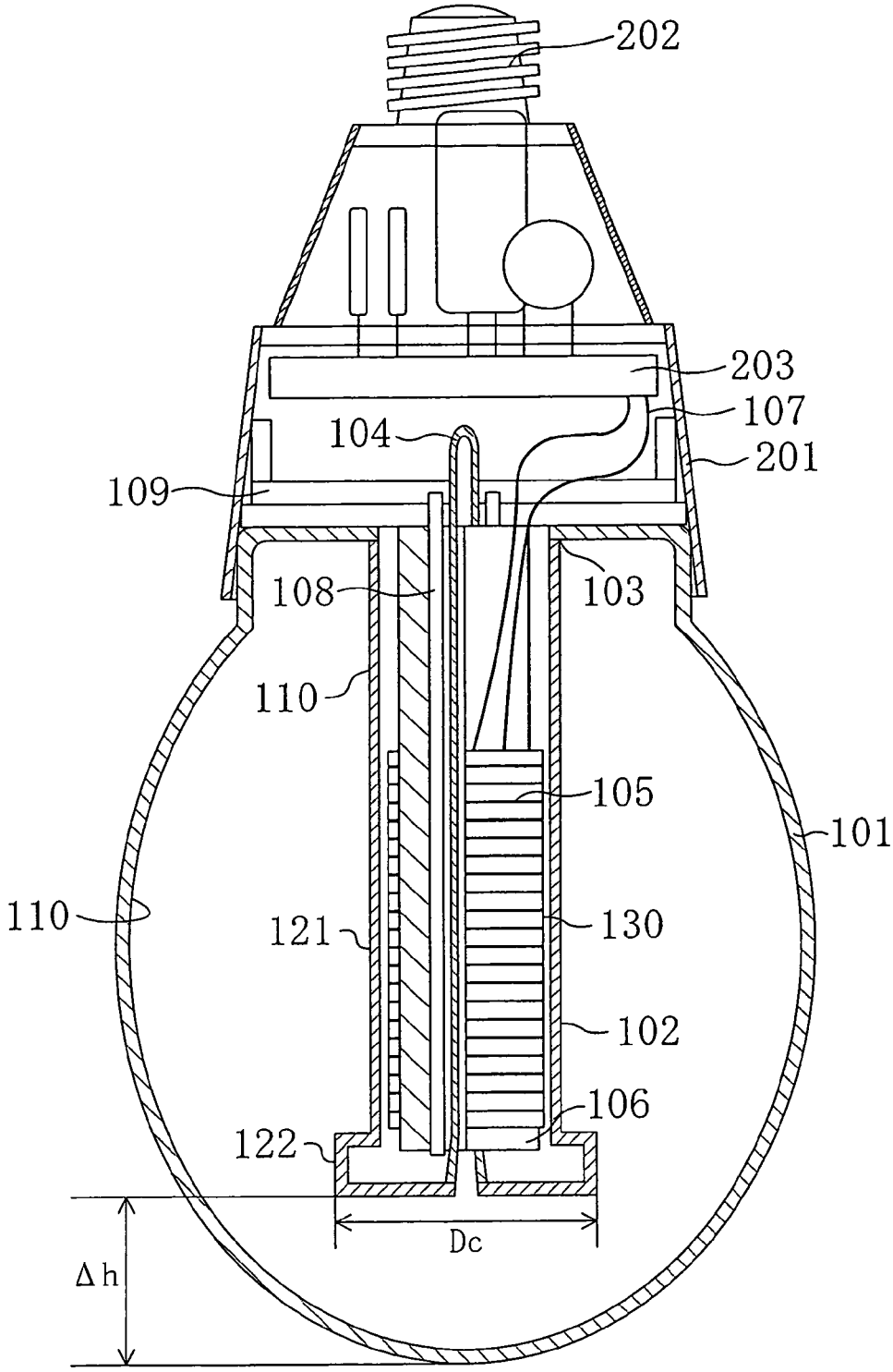
FIG. 14 schematically shows an electrodeless fluorescent lamp that is a modified mode of the preferred embodiment in accordance with the present invention.

FIG. 14 shows one example of still another preferred embodiment in accordance with the present invention. In this embodiment, a recessed portion 102 is formed by combining cylinders having two kinds of diameters. In the recessed portion 102, the diameter Dc of a portion located on the side opposite to the opening section, that is, a top face portion 122 of the recessed portion 102, is greater than the diameter of a portion at which the excitation coil 105 is located. With this arrangement, the distance between the recessed portion 121 on the center portion 130 in the longitudinal direction of the excitation coil 105 and the inner wall of the bulb 101 is made sufficiently longer so that it becomes possible to reduce the loss of plasma due to bipolar diffusion, and also to ensure a sufficient size of the diameter Dc of the top face portion 122 so as to suppress the convection of discharge gas.

The aforementioned embodiments have discussed a case in which the inner face of the bulb 101 is coated with a phosphor film (not shown); however, in the case of an electrodeless lamp also in which, without using the phosphor film, ultraviolet from mercury is directly utilized by forming the bulb 101 by the use of a material that transmits ultraviolet, for example, fused quartz having appropriate purity and magnesium fluoride, it becomes possible to optimize the strength of ultraviolet by controlling the coldest point temperature.

The aforementioned embodiments have discussed a case in which the lamp main body and the high-frequency power-supply circuit 203 are formed into an integral part; however, those embodiments may also be applied to a structure in which the high-frequency power-supply circuit 203 is installed as a separate part from the lamp main body.

Moreover, a visible-light reflection film or phosphor film, made of alumina or the like, or both of these films, may be formed on the top portion of the recessed portion 102 so as to reduce the influence from the outline shadow of the recessed portion 102 to the top portion of the bulb 101.

In FIGS. 1 and 8, the top of the recessed portion 102 has a square shape with corners; however, sharp corners are not necessarily required. The top may have round corners, or may be formed as a tilted top portion.

Furthermore, the aforementioned embodiments have discussed a structure in which the excitation coil 105 is inserted into the recessed portion 102; however, even in a structure in which the excitation coil 105 is wound around the outside of the bulb 101, with a higher driving frequency, for example, 13.56 MHz, being used, the influence of the recessed portion 102 to the coldest point temperature is the same, and the same effects can be achieved. Here, in a structure in which the excitation coil 105 is inserted to the recessed portion 102 also, when a high driving frequency, for example, 13.56 MHz, is used, the magnetic core 106 is not necessarily required. Moreover, in order to suppress the high-frequency magnetic field generated in the excitation coil 105 from causing an eddy current loss inside the radiating member 109 made of metal, a round plate, which is made of a magnetic material having low electric conductivity, preferably, Mn—Zn-based or Ni—Zn based soft magnetic ferrite, may be placed between the radiating member 109 and the uppermost portion of the bulb 101 shown in the figure.

As described above, in accordance with the present invention, it is possible to provide a compact self-ballasted electrodeless discharge lamp in which the temperature of a coldest point is maintained within an appropriate range by using a technique that is different from conventional techniques, and an electrodeless-discharge-lamp lighting device for use in such a lamp.

INDUSTRIAL APPLICABILITY

The present invention is effectively used for improving the light-emitting efficiency of an electrodeless-discharge-lamp lighting device, and in particular, is suitably applied to a compact self-ballistic electrodeless discharge lamp.

The invention claimed is:

1. A compact self-ballasted electrodeless discharge lamp comprising:

a bulb filled with discharge gas containing mercury enclosed in the bulb in the form of mercury element, not in the form of amalgam, and a rare gas;

an excitation coil installed near the bulb;

a ballast circuit which supplies high frequency power to the excitation coil; and a base that is electrically connected to the ballast circuit, wherein: the bulb, the excitation coil, the ballast circuit and the base are formed into an integral part;

the bulb has a virtually spherical shape or a virtually ellipsoidal shape;

a recessed portion to which the excitation coil is inserted is formed on the ballast circuit side of the bulb;

the recessed portion has an opening section on the ballast circuit side, and has a tube shape with a virtually round shape in a cross section thereof, with a portion positioned on a side opposite to the opening section of the recessed portion being provided with a function for suppressing the convection of the discharge gas;

a largest diameter of the bulb is set in a range from not less than 60 mm to not more than 90 mm;

a bulb wall loading of the bulb during a stable lighting operation is set in a range from not less than 0.07 $W/cm^2$ to not more than 0.11 $W/cm^2$;

a ratio (h/D) of a height (h) of the bulb based upon an end face of the opening section in the recessed portion to the largest diameter (D) of the bulb is set in a range from not less than 1.0 to not more than 1.3;

supposing that a distance between a top face of the recessed portion positioned on the side opposite to the opening section of the recessed portion and a top portion of the bulb facing the top face of the recessed portion is Δh, and that a diameter of a portion positioned on the side opposite to the opening section of the recessed portion is Dc, the following relationship is satisfied: $\Delta h \leqq 1.15 \times Dc + 1.25$ mm;

the excitation coil is constituted by a core and a coil wound around the core; and a center portion of a portion around which the coil is wound in the longitudinal direction of the core is positioned within a range that is apart from a plane on which the largest diameter of the bulb is located by a distance from not less than 8 mm to not more than 20 mm toward the ballast circuit side.

2. The compact self-ballasted electrodeless discharge lamp of claim 1, wherein the diameter Dc and the distance Δh satisfy the following relationship: $\Delta h \geqq 1.16 \times Dc - 17.4$ mm.

3. The compact self-ballasted electrodeless discharge lamp of claims 1 or 2, wherein the largest diameter of the bulb is set in a range from not less than 65 to not more than 80 mm.

4. A compact self-ballasted electrodeless discharge lamp comprising:

a bulb filled with discharge gas containing mercury enclosed in the bulb in the form of mercury element, not in the form of amalgam, and a rare gas;

an excitation coil installed near the bulb;

a ballast circuit which supplies high frequency power to the excitation coil; and a base that is electrically connected to the ballast circuit, wherein: the bulb, the excitation coil, the ballast circuit and the base are formed into an integral part;

the bulb has a virtually spherical shape or a virtually ellipsoidal shape;

a recessed portion to which the excitation coil is inserted is formed on the ballast circuit side of the bulb;

the recessed portion has an opening section on the ballast circuit side, and has a tube shape with a virtually round shape in a cross section thereof, with a portion positioned on a side opposite to the opening section of the recessed portion being provided with a function for suppressing the convection of the discharge gas;

a largest diameter of the bulb is set in a range from not less than 55 mm to not more than 75 mm;

a bulb wall loading of the bulb during a stable lighting operation is set in a range from not less than 0.05 $W/cm^2$ to less than 0.07 $W/cm^2$;

a ratio (h/D) of a height (h) of the bulb based upon an end face of the opening section in the recessed portion to the largest diameter (D) of the bulb is set in a range from not less than 1.0 to not more than 1.3;

supposing that a distance between a top face of the recessed portion positioned on a side opposite to the opening section of the recessed portion and a top portion of the bulb facing the top face of the recessed portion is Δh, and that a diameter of a portion positioned on the side opposite to the opening section of the recessed portion is Dc, the following relationship is satisfied: $\Delta h \leqq 1.92 \times Dc - 22.4$ mm;

the excitation coil is constituted by a core and a coil wound around the core; and a center portion of a portion around which the coil is wound in the longitudinal direction of the core is virtually positioned on a plane within which the largest diameter of the bulb is located.

5. The compact self-ballasted electrodeless discharge lamp of claim 4, wherein the diameter Dc and the distance Δh satisfy the following relationship: $\Delta h \geqq 1.16 \times Dc - 17.4$ mm.

6. The compact self-ballasted electrodeless discharge lamp of claim 4 or 5, wherein the largest diameter of the bulb is set in a range from not less than 60 mm to not more than 70 mm.

7. The compact self-ballasted electrodeless discharge lamp of claims 1 or 4, wherein the filling pressure of the rare gas is set in a range from not less than 60 Pa to not more than 300 Pa.

8. The compact self-ballasted electrodeless discharge lamp of claims 1 or 4, wherein a phosphor layer is formed on an inner surface of the bulb.

9. The compact self-ballasted electrodeless discharge lamp of claims 1 or 4, wherein the diameter Dc of a portion positioned on the side opposite to the opening section of the recessed portion is greater than the diameter of a portion corresponding to virtually the center portion of the recessed portion in a longitudinal direction of the excitation coil.

10. An electrodeless-discharge-lamp lighting device comprising:

a bulb which is filled with discharge gas containing mercury enclosed in the bulb in the form of mercury element, not in the form of amalgam, and a rare gas, and which has a recessed portion;

an excitation coil inserted in the recessed portion; and a ballast circuit which supplies high frequency power to the excitation coil, wherein: the bulb has a virtually spherical shape or a virtually ellipsoidal shape;

the recessed portion has an opening section on the ballast circuit side, and has a tube shape with a virtually round shape in a cross section thereof;

a largest diameter of the bulb is set in a range from not less than 60 mm to not more than 90 mm;

a bulb wall loading of the bulb during a stable lighting operation is set in a range from not less than 0.07 $W/cm^2$ to not more than 0.11 $W/cm^2$;

a ratio (h/D) of a height (h) of the bulb based upon an end face of the opening section in the recessed portion to the largest diameter (D) of the bulb is set in a range from not less than 1.0 to not more than 1.3;

supposing that a distance between a top face of the recessed portion positioned on a side opposite to the opening section of the recessed portion and a top portion of the bulb facing a top face of the recessed portion is Δh, and that a diameter of a portion positioned on a side opposite to the opening section of the recessed portion is Dc, the following relationship is satisfied: $\Delta h \leqq 1.15 \times Dc + 1.25$ mm; and the diameter Dc of a portion positioned on the side opposite to the opening section of the recessed portion is greater than the diameter of a portion corresponding to virtually a center portion of the recessed portion in the longitudinal direction of the excitation coil.

11. An electrodeless-discharge-lamp lighting device comprising:

a bulb which is filled with discharge gas containing mercury enclosed in the bulb in the form of mercury element, not in the form of amalgam, and a rare gas, and which has a recessed portion;

an excitation coil inserted in the recessed portion; and a ballast circuit which supplies high frequency power to the excitation coil, wherein: the bulb has a virtually spherical shape or a virtually ellipsoidal shape;

the recessed portion has an opening section on the ballast circuit side, and has a virtually cylinder shape with a virtually round tube shape in a cross section thereof;

a largest diameter of the bulb is set in a range from not less than 55 mm to not more than 75 mm;

a bulb wall loading of the bulb during a stable lighting operation is set in a range from not less than 0.05 $W/cm^2$ to less than 0.07 $W/cm^2$;

a ratio (h/D) of a height (h) of the bulb based upon an end face of the opening section in the recessed portion to the largest diameter (D) of the bulb is set in a range from not less than 1.0 to not more than 1.3;

supposing that a distance between a top face of the recessed portion positioned on a side opposite to the opening section of the recessed portion and a top portion of the bulb facing a top face of the recessed portion is $\Delta h$, and that a diameter of a portion positioned on the side opposite to the opening section of the recessed portion is Dc, the following relationship is satisfied: $\Delta h \leqq 1.92 \times Dc - 22.4$ mm; and the diameter Dc of a portion positioned on the side opposite to the opening section of the recessed portion is greater than the diameter of a portion corresponding to virtually a center portion of the recessed portion in the longitudinal direction of the excitation coil.

* * * * *

UNITED STATES PATENT AND TRADEMARK OFFICE

CERTIFICATE OF CORRECTION

PATENT NO. : 7,064,490 B2
APPLICATION NO. : 10/512127
DATED : June 20, 2006
INVENTOR(S) : Kiyoshi Hashimotodani et al.

It is certified that error appears in the above-identified patent and that said Letters Patent is hereby corrected as shown below:

In the Claims:

Column 19

Line 26, Claim 3: "claims" should be --claim--

Signed and Sealed this

Twenty-eighth Day of November, 2006

JON W. DUDAS
*Director of the United States Patent and Trademark Office*